US008391753B2

(12) United States Patent
Takashima et al.

(10) Patent No.: US 8,391,753 B2
(45) Date of Patent: Mar. 5, 2013

(54) POWDER CONTAINER AND IMAGE FORMING APPARATUS

(75) Inventors: Yoshiyuki Takashima, Ebina (JP); Hideki Kuge, Ebina (JP); Kouji Fukumuro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 12/781,600

(22) Filed: May 17, 2010

(65) Prior Publication Data

US 2011/0123232 A1 May 26, 2011

(30) Foreign Application Priority Data

Nov. 20, 2009 (JP) ..... 2009-265108

(51) Int. Cl.
*G03G 15/08* (2006.01)

(52) U.S. Cl. ..... 399/260; 399/110; 399/262

(58) Field of Classification Search ..... 399/120, 399/222, 252, 255, 258–263
See application file for complete search history.

(56) References Cited

U.S. PATENT DOCUMENTS

2002/0031374 A1* 3/2002 Matsuda et al. ..... 399/258
2008/0298835 A1 12/2008 Takashima

FOREIGN PATENT DOCUMENTS

JP 2008-298879 A 12/2008

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A powder container includes: a powder containing portion that has an opening formed thereon and contains powder inside thereof, the powder containing portion being attached to an image forming apparatus; a closing member, when the powder containing portion is attached to the image forming apparatus, whose movement is regulated by striking against a regulation member provided to the image forming apparatus to relatively move against the powder containing portion to open the opening, and the closing member, when the powder containing portion is detached from the image forming apparatus, whose movement is regulated by moving and making contact with the image forming apparatus to relatively move against the powder containing portion to close the opening; and a moving portion that moves the regulation member when the powder containing portion is detached from the image forming apparatus.

18 Claims, 27 Drawing Sheets

INSERTION OF TONER CARTRIDGE COMPLETED

INSERTION OF TONER CARTRIDGE COMPLETED

POWDER CONTAINER AND IMAGE FORMING APPARATUS

CROSS REFERENCE TO RELATED APPLICATIONS

This application is based on and claims priority under 35 USC §119 from Japanese Patent Application No. 2009-265108 filed Nov. 20, 2009.

BACKGROUND

1. Technical Field

The present invention relates to a powder container and an image forming apparatus.

2. Related Art

There is known an image forming apparatus including a powder container having a shutter to cover and open a powder supplying port.

SUMMARY

According to an aspect of the present invention, there is provided a powder container including: a powder containing portion that has an opening formed thereon and contains powder inside thereof, the powder containing portion being attached to an image forming apparatus; a closing member, when the powder containing portion is attached to the image forming apparatus, whose movement is regulated by striking against a regulation member provided to the image forming apparatus to relatively move against the powder containing portion to open the opening, and the closing member, when the powder containing portion is detached from the image forming apparatus, whose movement is regulated by moving and making contact with the image forming apparatus to relatively move against the powder containing portion to close the opening; and a moving portion that moves the regulation member when the powder containing portion is detached from the image forming apparatus.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described in detail with reference to the attached drawings.

Figure 1:
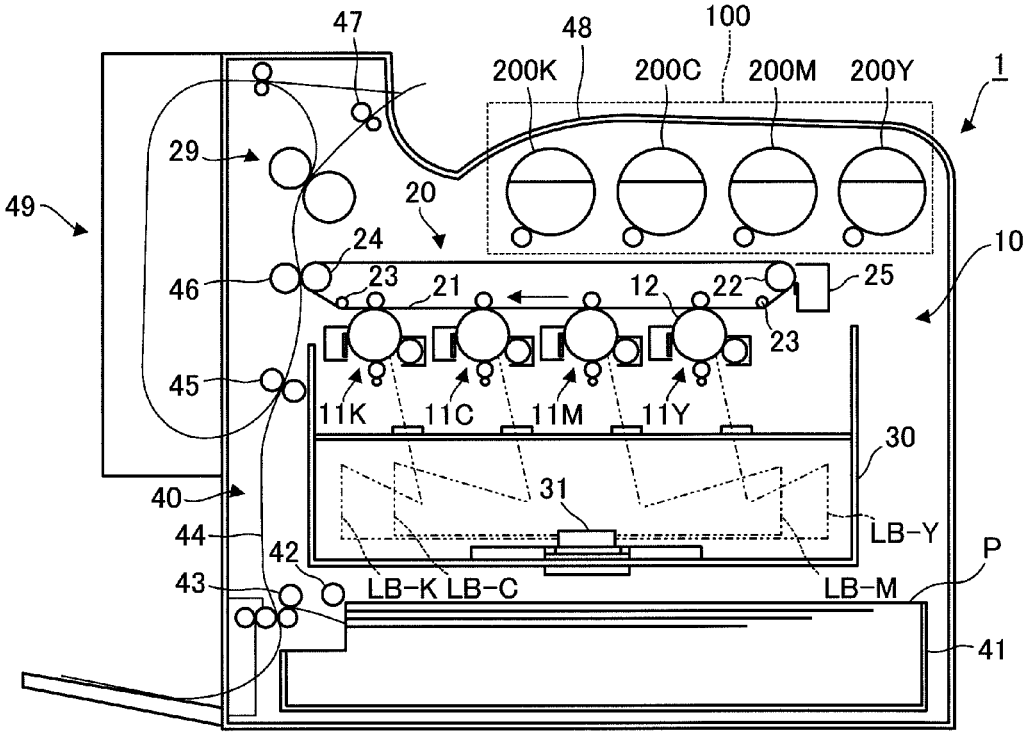
FIG. 1 is a view showing an entire configuration of an image forming apparatus, which is a so-called tandem-type digital color printer.

FIG. 1 shows an entire configuration of an image forming apparatus 1, which is a so-called tandem-type digital color printer. The image forming apparatus 1 shown in FIG. 1 includes: an image forming system 10 forming an image corresponding to gradation data of each color; a sheet transport system 40 transporting a sheet P; an image processing portion (not shown) executing predetermined image processing on image data received from a personal computer (PC) or a document scanning device, which are not shown, connected to the image processing portion; and a controlling portion (not shown) controlling operation of each part (each device).

The image forming system 10 includes four image forming units 11Y, 11M, 11C and 11K corresponding to the colors of yellow (Y), magenta (M), cyan (C) and black (K), respectively, which are arranged in parallel in a horizontal direction at a constant interval. The image forming system 10 also includes: a transfer unit 20 that performs, onto an intermediate transfer belt 21, multi-transfer of powder images of respective colors formed on photoconductive drums 12 of the image forming units 11Y, 11M, 11C and 11K; and a laser exposure device 30 that irradiates the image forming units 11Y, 11M, 11C and 11K with a laser beam. The image forming system 10 further includes a fixing device 29 that fixes the image secondarily transferred by the transfer unit 20 onto the sheet P by use of heat and pressure. Further, the image forming apparatus 1 according to the present exemplary embodiment is provided with powder cartridges 200Y, 200M, 200C and 200K, each of which is an example of a container and a powder container which contains a powder of each color and is detachably attached to the image forming apparatus 1. A supplying mechanism 100 is also provided to supply powder contained in each of the powder cartridges 200Y, 200M, 200C and 200K to developing devices 16Y, 16M, 16C and 16K (described later) mounted to the image forming units 11Y, 11M, 11C and 11K, respectively. The powder cartridge according to the present invention may contain a toner, a resin powder, a metallic powder and the like as the powder.

The transfer unit 20 includes: a driving roller 22 that drives the intermediate transfer belt 21; tension rollers 23 that apply a constant tension to the intermediate transfer belt 21; a backup roller 24 for performing secondary transfer of the superimposed powder images of respective colors onto the sheet P; and a belt cleaner 25 that removes residual powder remaining on the intermediate transfer belt 21. The intermediate transfer belt 21 is wound around the driving roller 22, the tension rollers 23 and the backup roller 24 with a constant tension, and circularly driven by the driving roller 22 in a direction of an arrow in the figure at a predetermined speed.

The laser exposure device 30 includes, as well as a laser diode that is not shown and a modulator, a polygon mirror 31 that deflects the laser beam (LB-Y, LB-M, LB-C, LB-K) and performs scanning with the laser beam. The sheet transport system 40 includes: a stacking portion 41 that stacks the sheets P on which an image is to be recorded; a supply roller 42 that picks the sheets P up from the stacking portion 41 and supplies the sheets P; a feed roller 43 that separates the sheets P supplied by the supply roller 42 one by one and transports the sheet P; and a transport path 44 that transports the sheet P separated one by one by the feed roller 43 to an image transfer portion. The sheet transport system 40 also includes: a registration roller 45 that transports the sheet P transported by the transport path 44 toward a secondary transfer position while adjusting timing; and a secondary transfer roller 46 that is provided at the secondary transfer position and makes press-contact with the backup roller 24 to carry out secondary transfer of the image onto the sheet P. The sheet transport system 40 further includes: an discharge roller 47 that outputs the sheet P on which the image has been fixed by the fixing device 29 out of the apparatus; and a stacking portion 48 that stacks the sheets P outputted by the discharge roller 47. In the present exemplary embodiment, a duplex transport unit 49 is provided to enable duplex recording by inverting the sheet P subjected to fixing by the fixing device 29.

Figure 2:
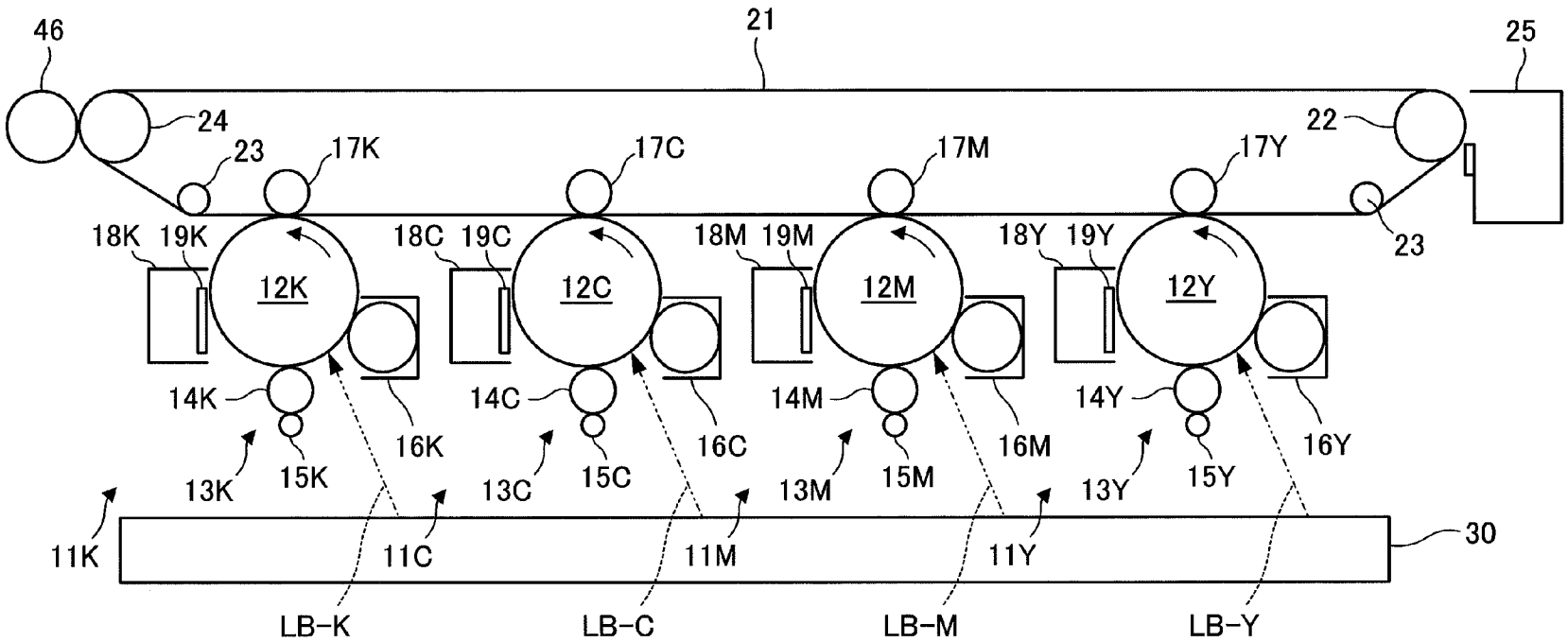
FIG. 2 is a view illustrating image forming units.

Next, the image forming units 11Y, 11M, 11C and 11K in the image forming system 10 will be described in detail. FIG. 2 illustrates the image forming units 11Y, 11M, 11C and 11K.

Each of the image forming units 11Y, 11M, 11C and 11K includes, taking the image forming unit 11Y for yellow color as an example for explanation: a photoconductive drum 12Y; a charging device 13Y for charging the photoconductive drum 12Y; and a developing device 16Y that develops the electrostatic latent image formed on the photoconductive drum 12Y by a laser beam LB-Y emitted from the laser exposure device 30. A main part of the charging device 13Y is constituted by a charging roller 14Y arranged in contact with the photoconductive drum 12Y and a cleaning roller 15Y that cleans the charging roller 14Y.

The image forming unit 11Y is provided with a primary transfer roller 17Y disposed to face the photoconductive drum 12Y across the intermediate transfer belt 21 for transferring a powder image developed on the photoconductive drum 12Y onto the intermediate transfer belt 21. Further, the image forming unit 11Y is provided with a drum cleaner 18Y that removes residual powder on the photoconductive drum 12Y by using a cleaning blade 19Y being arranged in contact with the photoconductive drum 12Y. Other image forming units 11M, 11C and 11K have the same configuration with the image forming unit 11Y for yellow color.

Next, basic image forming operation of the image forming apparatus 1 will be explained. A coloring material reflective light image of the document read by the document scanning device (not shown) or coloring material image data formed by the personal computer which is not shown, for example, is inputted to the image processing portion (not shown) as reflectance data of 8-bit red (R), green (G) and blue (B) color components, for example. The image processing portion executes predetermined image processing, such as shading correction, misregistration correction, lightness/color space conversion, gamma correction and various kinds of image editing such as frame erase, color editing and movement editing, on the inputted reflectance data. The image data subjected to the image processing is converted into coloring material gradation data of four color components of yellow (Y), magenta (M), cyan (C) and black (K) and outputted to the laser exposure device 30.

The laser exposure device 30 outputs the laser beam (LB-Y, LB-M, LB-C and LB-K) outputted from the laser diode (not shown) to the polygon mirror 31 via an f-• lens (not shown) in response to the inputted coloring material gradation data. The polygon mirror 31 modulates the incident laser beam according to the gradation data of each color component, deflects and scans to irradiate the photoconductive drum 12 in the image forming units 11Y, 11M, 11C and 11K through an imaging lens and plural mirrors that are not shown. In the photoconductive drum 12 in the image forming units 11Y, 11M, 11C and 11K, a charged surface is exposed and scanned and thus an electrostatic latent image is formed thereon. The formed electrostatic latent image is developed into a powder image of each of the color components yellow (Y), magenta (M), cyan (C) and black (K) in each of the image forming units 11Y, 11M, 11C and 11K, respectively. Then, the powder images formed on the photoconductive drums 12 in the image forming units 11Y, 11M, 11C and 11K are multiply-transferred onto the intermediate transfer belt 21.

In the transport system 40, the supply roller 42 rotates according to the timing of image formation, thereby supplying the sheets P from the stacking portion 41. Then the sheet P separated one by one by the feed roller 43 is transported to the registration roller 45 via the transport path 44 and temporarily stopped. Thereafter, the registration roller 45 rotates according to movement timing of the intermediate transfer belt 21 on which the powder image is formed, and the sheet P is transported to the secondary transfer position formed by the backup roller 24 and the secondary transfer roller 46. At the secondary transfer position, the powder images of the superimposed four color components are sequentially transferred in the slow scanning direction by use of a press-contact force and an electric field. Then the sheet P on which the powder image has been transferred is subjected to the fixing process in the fixing device 29 and stacked in the stacking portion 48 by the discharge roller 47.

Next, the supply mechanism 100 will be described in detail.

Figure 3:
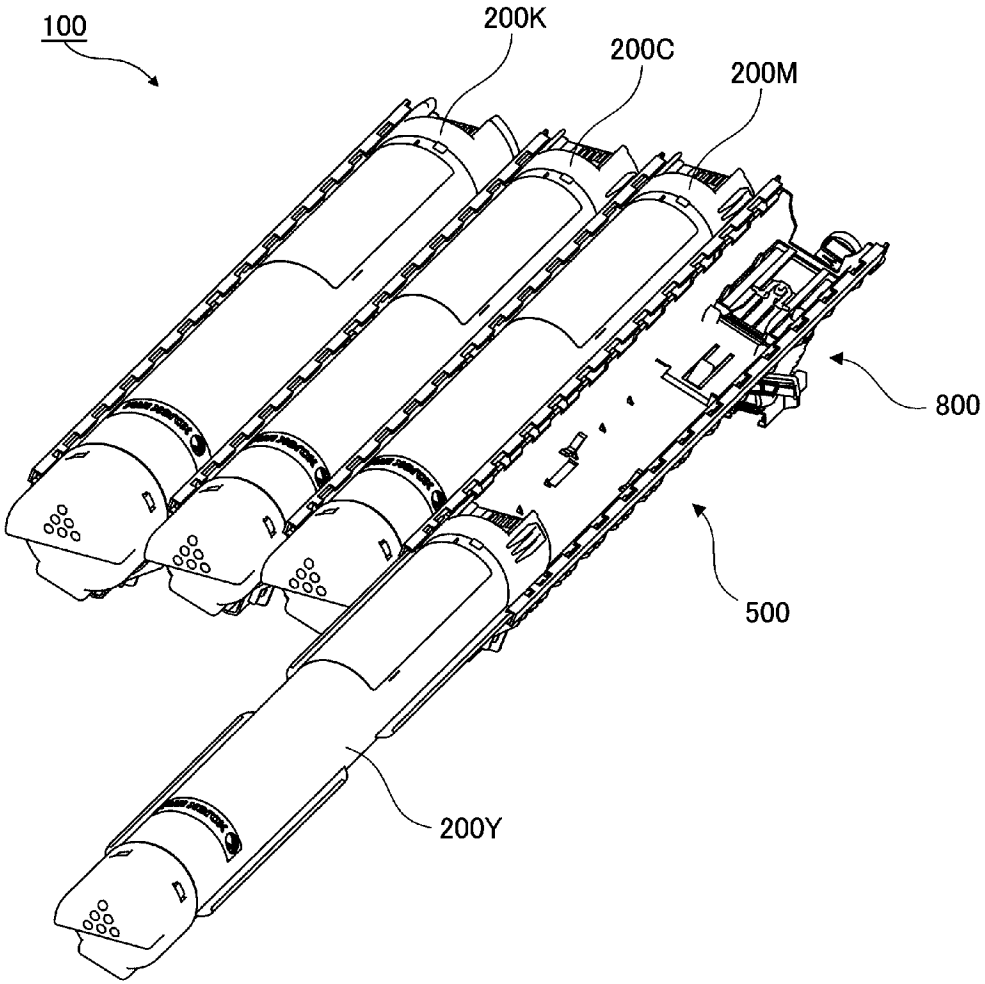
FIG. 3 is a perspective view illustrating powder cartridges and a supply mechanism.

FIG. 3 is a perspective view illustrating powder cartridges 200Y, 200M, 200C, 200K and the supply mechanism 100.

The supply mechanism 100 in the present exemplary embodiment is provided with accommodation portions 500 that are corresponding to the respective powder cartridges 200Y, 200M, 200C and 200K and accommodate the respective powder cartridges 200Y, 200M, 200C and 200K. Also, a powder transport portion 800 is provided to transport the powder discharged from the powder cartridges 200Y, 200M, 200C and 200K accommodated in the accommodation portions 500 to the developing device 16Y, 16M, 16C and 16K. In the present exemplary embodiment, the powder cartridges 200Y, 200M, 200C and 200K are configured to be inserted into the image forming apparatus 1 from the front side to the rear side thereof. The powder cartridges 200Y, 200M, 200C and 200K are also configured to be detached from the image forming apparatus 1 by pulling the cartridges toward the front side of the image forming apparatus 1. In the image forming apparatus 1, the location where the accommodation portions 500 are provided may be captured as an attachment portion to which the powder cartridges 200Y, 200M, 200C and 200K are attached.

Figure 4:
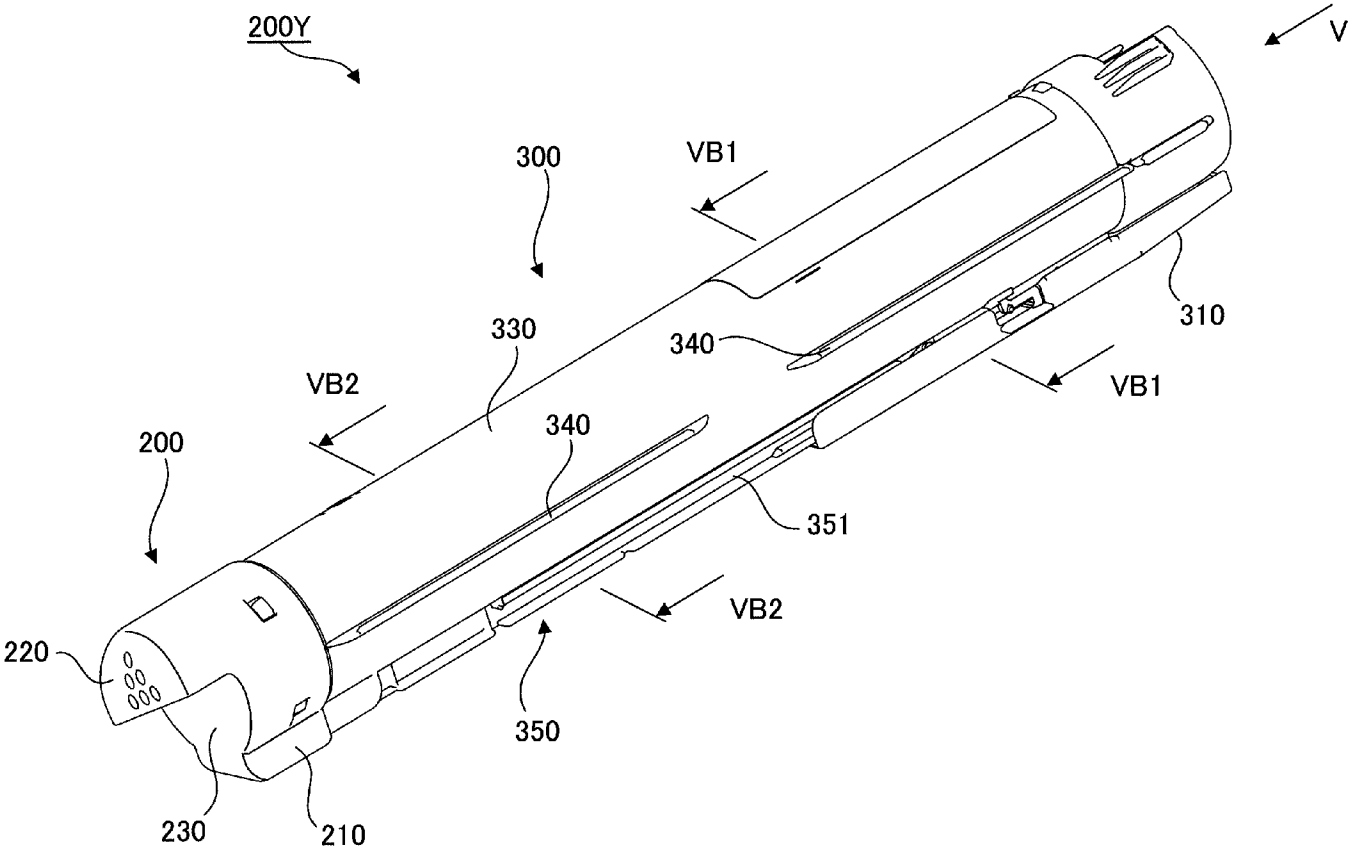
FIG. 4 is a view illustrating the powder cartridges.

FIG. 4 illustrates the powder cartridges 200Y, 200M, 200C and 200K. The powder cartridges 200Y, 200M, 200C and 200K have the same configuration, and therefore the powder cartridge 200Y is taken as an example in the explanation below. As shown in the figure, the powder cartridge 200Y is formed to be cylindrical and to have a predetermined length. More specifically, the powder cartridge 200Y includes an operation portion 200 which is operated by a user when the powder cartridge 200Y is attached to or detached from the image forming apparatus 1 and a main body portion 300 as an example of a powder containing portion which is formed to be cylindrical with an end portion and the other end portion, and contains the powder inside thereof.

The operation portion (operation member) 200 is formed to be cylindrical with one end being closed. The operation portion 200 is attached to one end of the main body portion 300 in a state of covering the one end of the main body portion 300. Specifically, the operation portion 200 includes: a base 230 formed to be cylindrical; a first projection portion 210 that projects in a radial direction of the base 230 from an outer circumferential surface of the base 230; and a second projection portion 220 that projects in an axial direction of the powder cartridge 200Y from an end surface of the base 230. Here, a gap (not shown) is formed inside the second projection portion 220, to which user's fingers are insertable, and thus the operation portion 200 is provided with a form to allow the powder cartridge 200Y to be easily pulled out.

The main body portion 300 includes a base 330 which is cylindrical and contains the powder inside thereof, and rotation regulation portions 340 provided to project from an outer circumferential surface of the base 330 along the axial direction of the powder cartridge 200Y in contact with the accommodation portion 500 for regulating the rotation of the powder cartridge 200Y in a circumferential direction. The main body portion 300 also includes a first shutter 310 provided to be movable along with the axial direction of the powder cartridge 200Y and facing a second shutter 320 (described later) to cover the second shutter 320, and a shutter guide portion 350 that guides the first shutter 310 and the second shutter 320 when these shutters move. The shutter guide portion 350 is provided to projects in a radial direction of the base 330 from the outer circumferential surface of the base 330 and provided along the axial direction of the powder cartridge 200Y. The shutter guide portion 350 is formed to be a rectangular parallelepiped, and has a first guide groove 351 on each of side surfaces (one side surface is not shown) for guiding the first shutter 310 which is provided along the axial direction of the powder cartridge 200Y and moves.

Figure 5A:
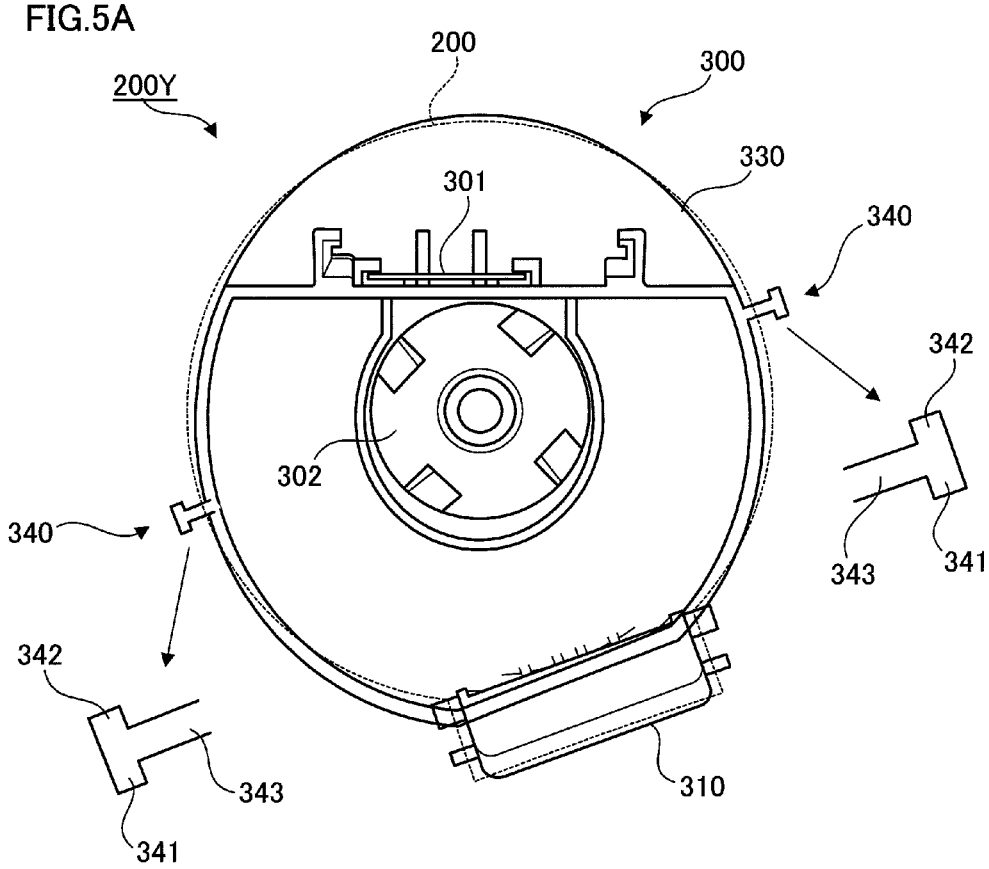
FIGS. 5A and 5B are views showing a powder cartridge as viewed from a front-end side thereof.
Figure 5B:
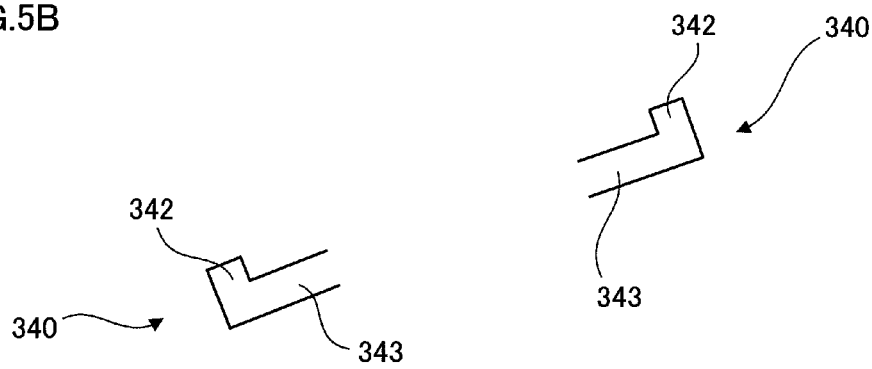

FIGS. 5A and 5B show the powder cartridge 200Y as viewed from the front-end side thereof. More specifically, these figures show the powder cartridge 200Y as viewed from the direction of arrow V in FIG. 4.

As shown in FIG. 5A, a memory 301 is mounted to the powder cartridge 200Y. In the memory 301, for example, information regarding powder use status, information regarding powder color, information regarding a contained amount of powder, information regarding powder manufacture, and the like are stored. The powder cartridge 200Y is provided with a connecting member 302 that is connected to a connected member 810 (refer to FIG. 17) provided to the image forming apparatus 1 side when the powder cartridge 200Y is attached to the image forming apparatus 1, and receives a driving force from the image forming apparatus 1 side. In the present exemplary embodiment, the driving force is transmitted, via the connecting member 302, to a transport member (later described) provided inside the powder cartridge 200Y, thereby transporting the inside powder to a powder discharge port (not shown in the figures) by driving the transport member.

Here, the rotation regulation portion 340 will be described in detail. In the present exemplary embodiment, a couple of rotation regulation portions 340 are provided at different positions in the circumferential direction of the powder cartridge 200Y. One of the rotation regulation portions 340 is provided on one side of the base 340 and the other rotation regulation portion 340 is provided on the other side of the base 330, in other words, on a side opposite to the one of the rotation regulation portions 340 across the base 330. Each rotation regulation portion 340 is formed to have a T-shaped cross section.

To be described in more detail, the rotation regulation member 340 is provided along the axial direction of the powder cartridge 200Y, and includes a base portion 343 projecting in a radial direction of the base 330 from the outer circumferential surface of the base 330. Each rotation regulation portion 340 has a first projection portion 341 that is arranged in an orthogonal relationship (intersecting relationship) to the base portion 343 and projects downwardly from the tip portion of the base portion 343. Each rotation regulation portion 340 is also provided with a second projection portion 342 that is arranged in an orthogonal relationship (intersecting relationship) to the base portion 343 and projects upwardly from the tip portion of the base portion 343.

In other words, each rotation regulation portion 340 has the first projection portion 341 extending from the tip portion of the base portion 343 in one direction and the second projection portion 342 extending from the tip portion of the base portion 340 in a direction opposite to the one direction. Further, in other words, each rotation regulation portion 340 includes the first projection portion 341 that is arranged to face the outer circumferential surface of the base 330 with a gap therebetween, as well as being arranged along a direction in which a tangential line to the outer circumferential surface of the base 330 extends. Similarly, each rotation regulation portion 340 is provided with the second projection portion 342 arranged to face the outer circumferential surface of the base 330 with a gap therebetween, as well as being arranged along a direction in which a tangential line to the outer circumferential surface of the base 330 extends. In the same manner with the base portion 343, the first projection portion 341 and the second projection portion 342 are provided along the axial direction of the powder cartridge 200Y. Here, FIG. 5A also shows the operation potion 200 (refer to a broken line), in which an outer shape of the operation portion 200 follows an outer shape of the main body portion 300.

In the rotation regulation portion 340, a part positioned at the front end portion of the powder cartridge 200Y is formed to have a T-shaped cross-section as described above. Meanwhile a part positioned at a central portion or rear end portion of the powder cartridge 200Y in the longitudinal direction is formed to have an L-shaped cross section. Here, FIG. 5B shows a cross-sectional view of the rotation regulation portion 340 taken along the lines VB1-VB1 and VB2-VB-2 in FIG. 4, and as shown in the figure, the central portion and the rear end portion of the powder cartridge 200Y in the longitudinal direction are formed to have L-shaped cross-section.

Specifically, the above-described first projection portion 341 is not provided to the central portion and the rear end portion, but the base portion 343 and the second projection portion 342 constitute the rotation regulation portion 340.

Figure 6:
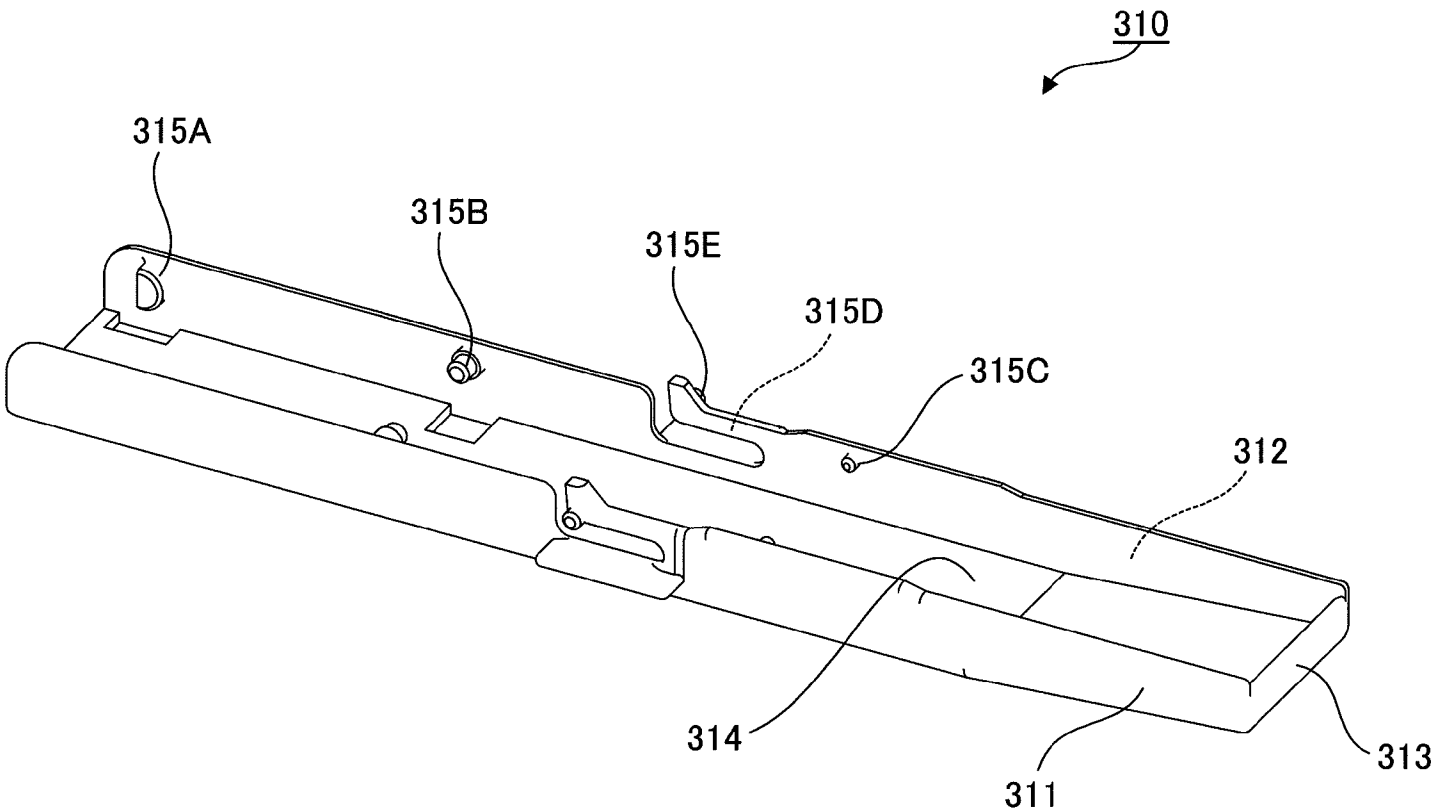
FIG. 6 is a perspective view showing a first shutter.

FIG. 6 is a perspective view showing the first shutter 310.

As shown in the figure, the first shutter 310 is formed like a box with an upper portion thereof (a side facing the base 330 (refer to FIG. 4) of the main body portion 300) being opened. More specifically, the first shutter 310 includes: a facing portion 314 that is formed to be flat and rectangular, and arranged to face the base 330 of the main body portion 300; a first side wall 311 extending from a long side of the facing portion 314 toward the base 330; a second side wall 312 extending from another long side of the facing portion 314 toward the base 330; and a third side wall 313 extending from, among two short sides of the facing portion 314, a short side positioned closer to the front end portion of the powder cartridge 200Y toward the base 330.

The first shutter 310 also includes, on an inner surface of the first side wall 311 and an inner surface of the second side wall 312, a pair of first protrusions 315A, a pair of second protrusions 315B and a pair of third protrusions 315C, in each of which the protrusions are arranged to face each other. In the present exemplary embodiment, a diameter of the second protrusion 315B is smaller than that of the first protrusion 315A. Further, the first shutter 310 includes a swing piece 315D which has elasticity and is swingable upwardly and downwardly in the figure on each of the first side wall 311 and the second side wall 312, and further includes a fourth protrusion 315E provided on a tip portion of the swing piece 315D to protrude outward of the first shutter 310.

Further description will be given of the powder cartridge 200Y.

Figure 7:
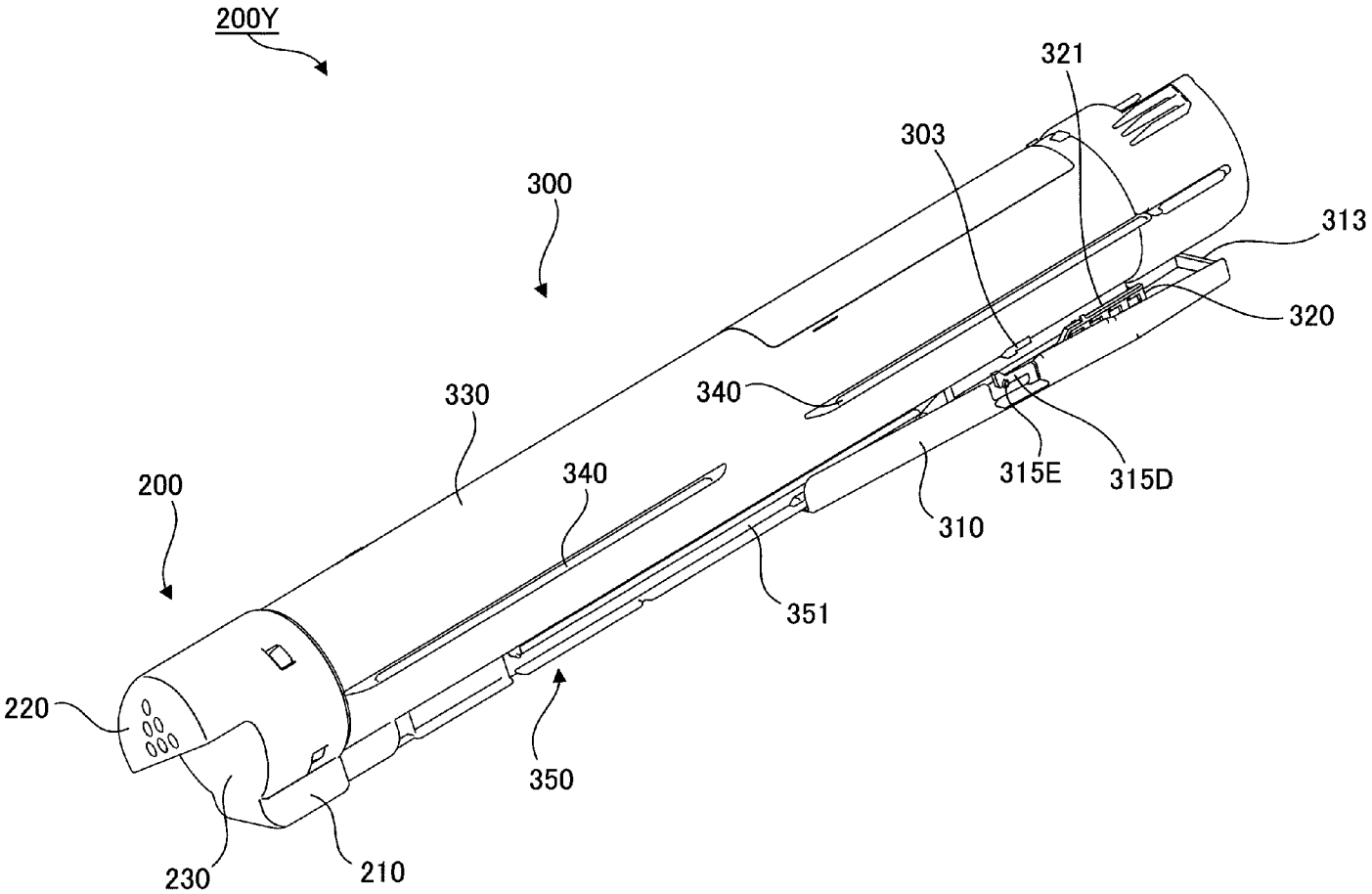
FIG. 7 is a view showing a state of the powder cartridge immediately after insertion of the powder cartridge into the image forming apparatus is started.
Figure 8:
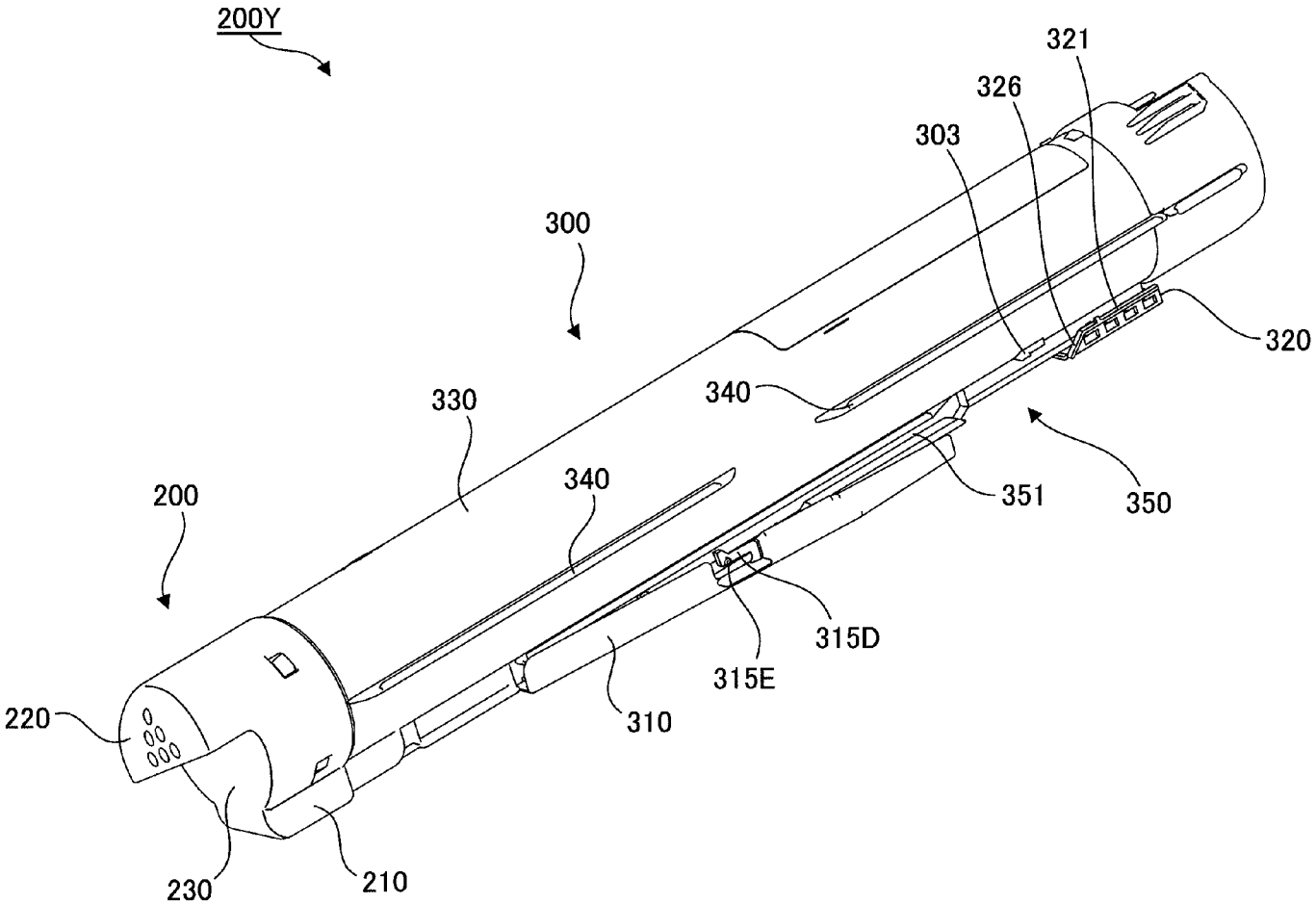
FIG. 8 is a view showing a state of the powder cartridge halfway through the insertion thereof.

FIG. 7 shows a state of the powder cartridge 200Y immediately after the insertion of the powder cartridge 200Y into the image forming apparatus 1 is started. FIG. 8 shows a state of the powder cartridge 200Y halfway through the insertion of the powder cartridge 200Y into the image forming apparatus 1.

Though explanation has been omitted in the above description, as shown in FIG. 7, the powder cartridge 200Y has a regulation protrusion 303 which is provided at a lower portion of the base 330 to strike the fourth protrusion 315E provided to the first shutter 310 for regulating backward movement of the first shutter 310. In a state where the powder cartridge 200Y is detached from the image forming apparatus 1, the fourth protrusion 315E strikes the regulation protrusion 303, thus going into a state where the backward movement of the first shutter 310 is regulated. Also, in the state where the powder cartridge 200Y is detached from the image forming apparatus 1, the third protrusion 315C (refer to FIG. 6) provided to the first shutter 310 strikes an upper edge portion 321 of the second shutter 320 (the third protrusion 315C is located between the upper edge portion 321 and the outer circumferential surface of the base 330), thus regulating movement of the first shutter 310 in a direction away from the base 330.

In the present exemplary embodiment, when the powder cartridge 200Y is inserted into the image forming apparatus 1, the fourth protrusion 315E is pressed by the accommodation portion 500 (refer to FIG. 3) in the direction away from the base 330 (lower light direction in the figure) and in the direction that the first shutter 310 moves backwardly (lower left direction in the figure) (described in detail later). Accordingly, the above-described striking between the fourth protrusion 315E and the regulation protrusion 303 is disengaged, and the first shutter 310 moves backwardly to a predetermined position. Thereafter, the above-described striking between the upper edge portion 321 of the second shutter 320 and the third protrusion 315C is disengaged while the second protrusion 315B (refer to FIG. 6) strikes a slope (not shown) provided in the first guide groove 351, thereby displacing the first shutter 310 such that the front end portion thereof hangs down.

After that, the powder cartridge 200Y further proceeds inwardly of the image forming apparatus 1, but movement of the first shutter 310 is regulated by the accommodation portion 500, and thus the first shutter 310 stops at a predetermined position of the accommodation portion 500. Consequently, as shown in FIG. 8, the second shutter 320 provided on the front end side of the powder cartridge 200Y is exposed. After the striking between the upper edge portion 321 of the second shutter 320 and the third protrusion 315C is disengaged, the second protrusion 315B (refer to FIG. 6) comes to strike the inner wall of the first guide groove 351 provided to the shutter guide portion 350. Thereby, the displacement (hanging down) of the first shutter 310 stops at a predetermined position.

Figure 9:
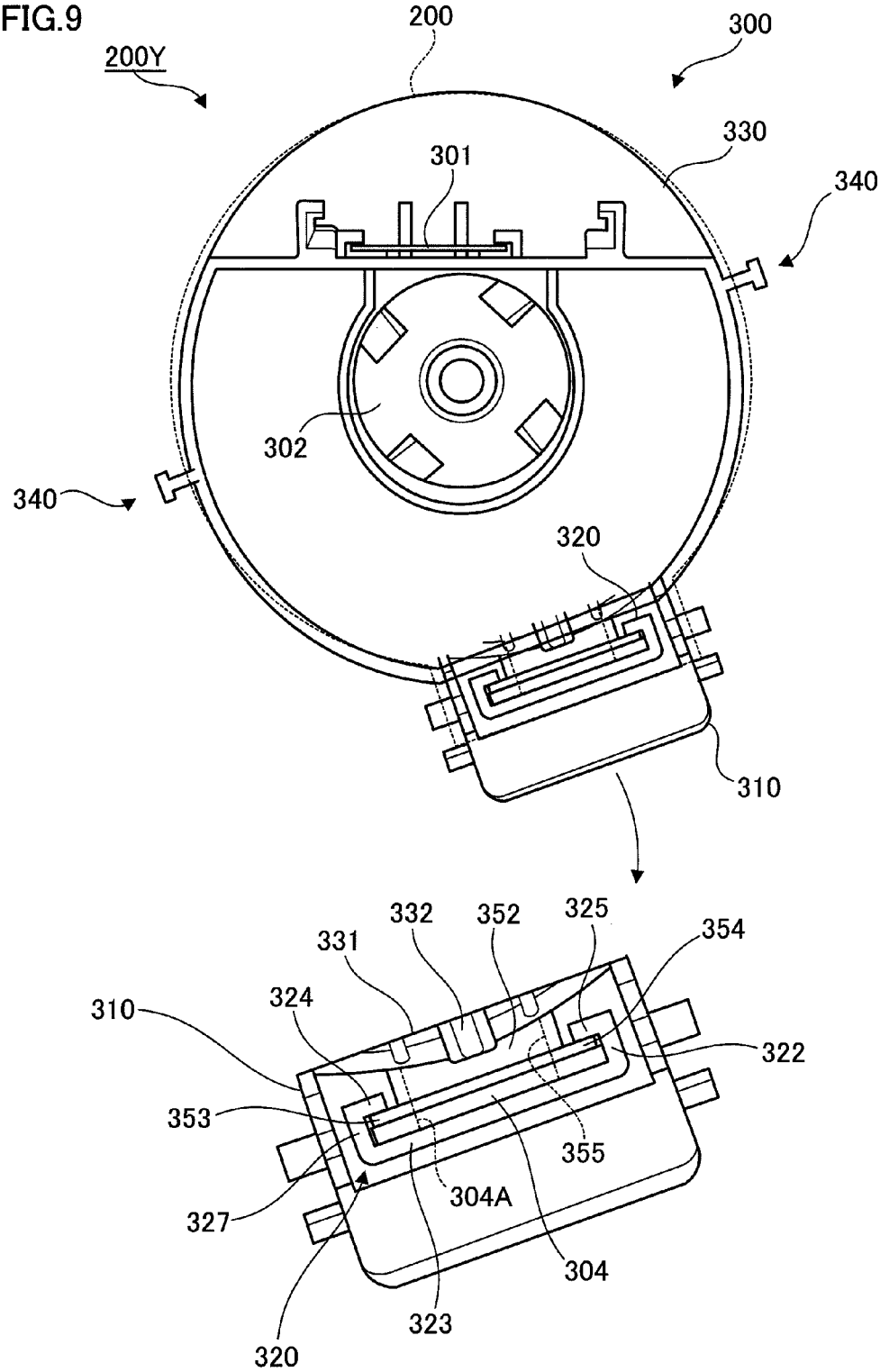
FIG. 9 is a view showing the powder cartridge in a state after the first shutter moves backwardly, as viewed from the front end portion side of the powder cartridge.

FIG. 9 shows the powder cartridge 200Y in a state after the first shutter 310 moves backwardly, as viewed from the front end portion side of the powder cartridge 200Y. The configuration of the front end side of the powder cartridge 200Y will be further described using FIG. 9.

As shown in the figure, in the base 330, a part positioned at the front end portion of the powder cartridge 200Y is provided with a chamfered flat surface 331. The flat surface 331 is provided with a protrusion 332 that protrudes in a direction away from the flat surface 331. The protrusion 332 is provided closer to the front end portion of the powder cartridge 200Y than the shutter guide portion 350 (refer to FIG. 8). In the present exemplary embodiment, the shutter guide portion 350 includes: a guide main body portion 352 that projects in the radial direction of the base 330 from the outer circumferential surface of the base 330 and is provided along the axial direction of the powder cartridge 200Y; and a first protrusion 353 that protrudes from one side surface of the guide main body portion 352 and extends along the axial direction of the powder cartridge 200Y.

The shutter guide portion 350 also includes a second protrusion 354 that protrudes from the other side surface of the guide main body portion 352 and extends along the axial direction of the powder cartridge 200Y. In the guide main body portion 352, a through hole 355 is formed to discharge the powder contained inside the powder cartridge 200Y. In the present exemplary embodiment, a sealing member 304, which has elasticity and is formed to be rectangular, and has a through hole 304A formed in the central portion thereof is put on an upper surface of the guide main body portion 352 The sealing member 304 may be formed of urethane rubber or foamed polyurethane.

The second shutter 320, as an example of a closing member, has: a covering portion 323 that is formed to be flat and arranged to face the sealing member 304 to cover the through hole 304A formed on the sealing member 304; a first side portion 327 that extends from one end portion of the covering portion 323 in the width direction thereof toward the base 330; a second side portion 322 that extends from the other end portion in the width direction thereof toward the base 330; a first facing portion 324 that is connected to the first side portion 327 and arranged to face the covering portion 323; and a second facing portion 325 that is connected to the second side portion 322 and arranged to face the covering portion 323. In the present exemplary embodiment, the first protrusion 353 and the sealing member 304 are held between the first facing portion 324 and the covering portion 323, and the second protrusion 354 and the sealing member 304 are held between the second facing portion 325 and the covering portion 323. Accordingly, the sealing member 304 is in a state of being compressed.

Figure 10:
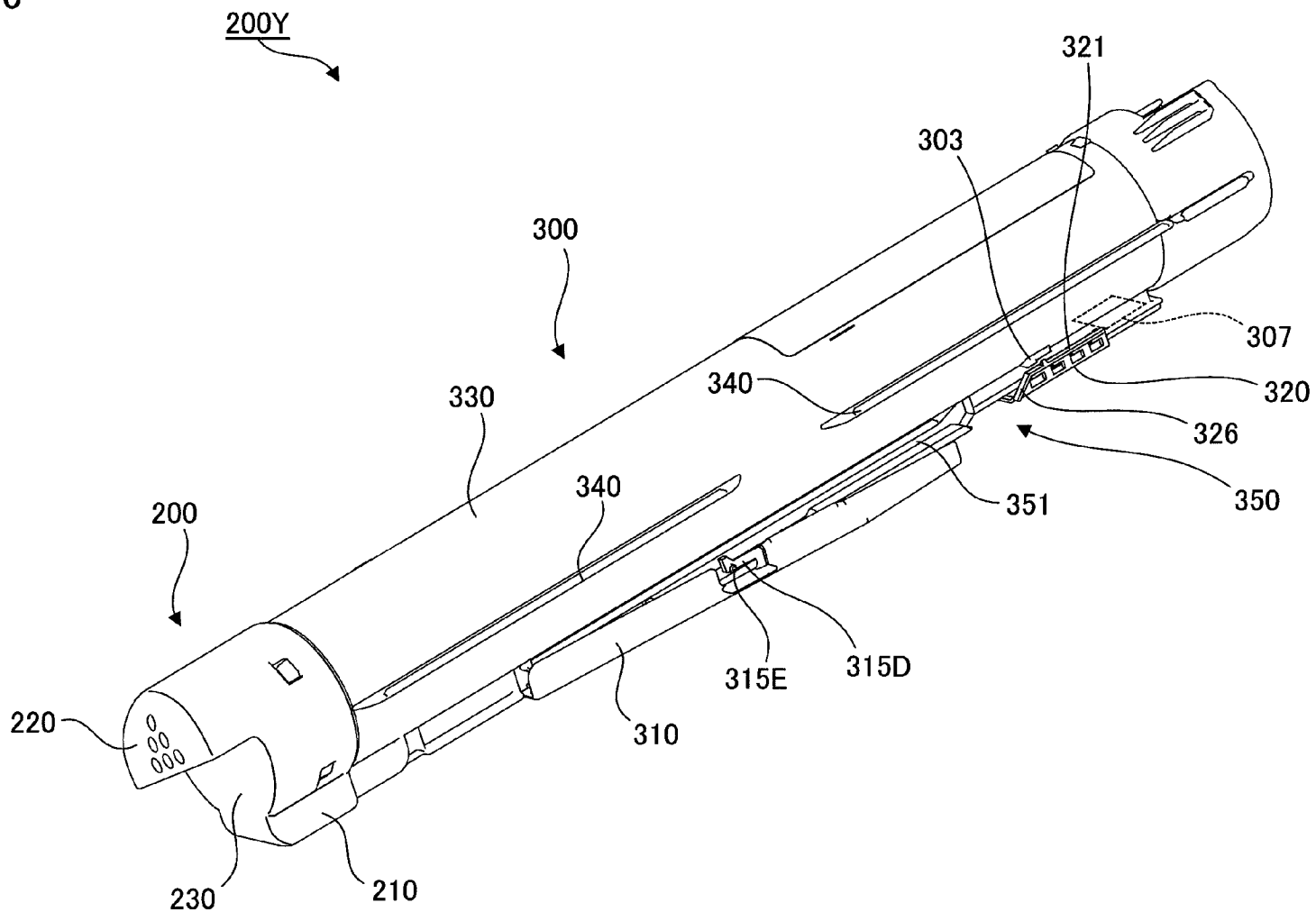
FIG. 10 is a view showing the powder cartridge in a state after the insertion thereof into the image forming apparatus is completed.

FIG. 10 shows the powder cartridge 200Y in a state after the insertion of the powder cartridge 200Y into the image forming apparatus 1 is completed.

If the powder cartridge 200Y is further inserted from the state shown in FIG. 8, the second shutter 320 strikes a predetermined part of the accommodation portion 500 (refer to FIG. 3), and thus movement of the second shutter 320 is stopped. Consequently, the through hole 304A (refer to FIG. 9) of the sealing member 304 having been closed by the second shutter 320 is opened. As a result, as shown in FIG. 10, a powder discharge port 307 (an example of an opening) through which the powder is sequentially discharged is formed on the lower portion of the powder cartridge 200Y.

When the powder cartridge 200Y is pulled out of the image forming apparatus 1, the above-described operation is executed in reverse order. That is, the powder discharge port 307 is closed by relative proceeding of the second shutter 320 against the main body portion 300 of the powder cartridge 200Y. Further, by relative proceeding of the first shutter 310, the second shutter 320 is covered with the first shutter 310. Though explanation has been omitted in the above description, as shown in FIG. 8, a slope 326, which is provided to be connected to the upper edge portion 321 and approaches the base 330 along with a move toward the front end portion of the powder cartridge 200Y, is formed on the second shutter 320. When the first shutter 310 proceeds, the third protrusion 315C (refer to FIG. 6) provided to the first shutter 310 goes on the slope 326. Accordingly, the front end portion of the first shutter 310 approaches the base 330 and the second shutter 320 is covered with the first shutter 310.

The powder cartridge 200Y will be further described.

Figure 11:
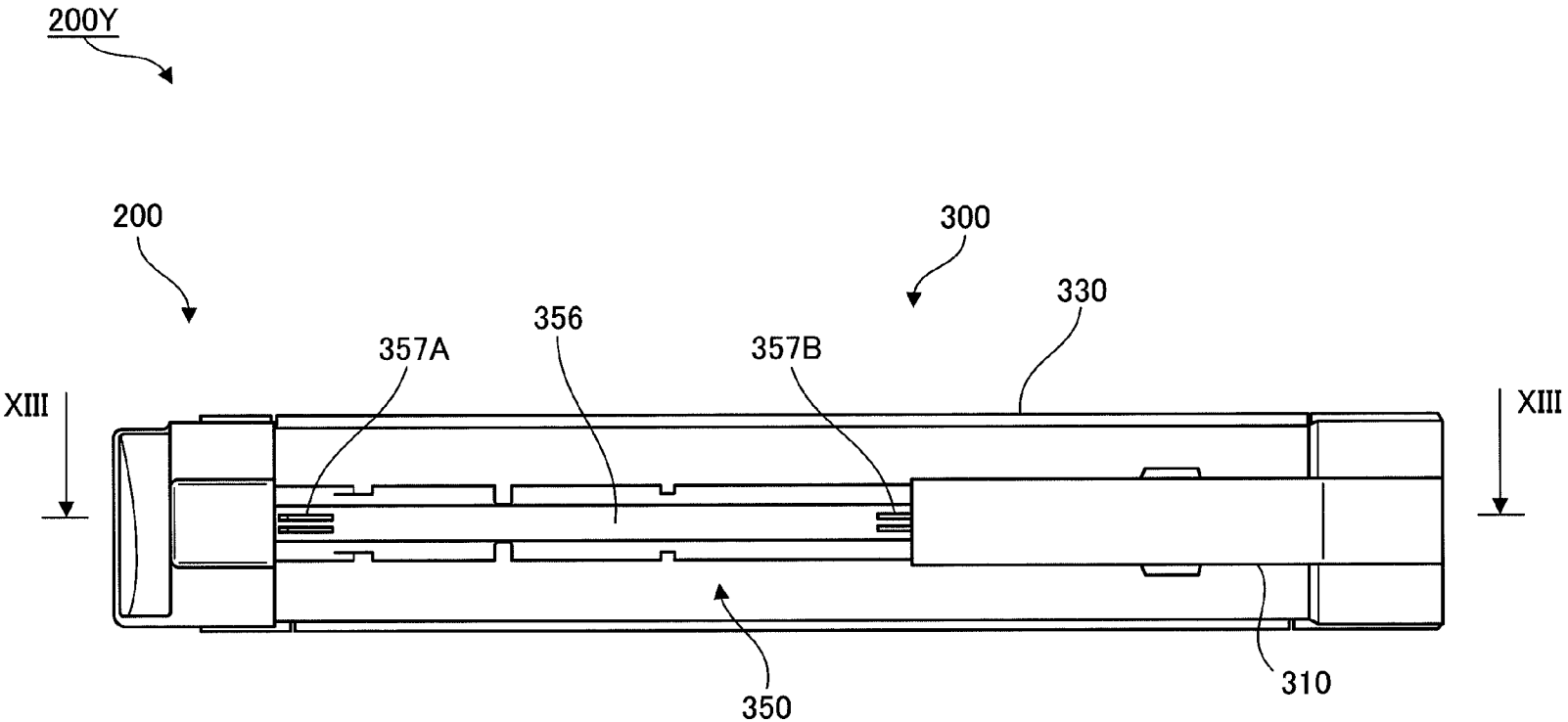
FIG. 11 is a view showing the powder cartridge in a state where the first shutter is closed, as viewed from the bottom portion side of the powder cartridge.
Figure 12:
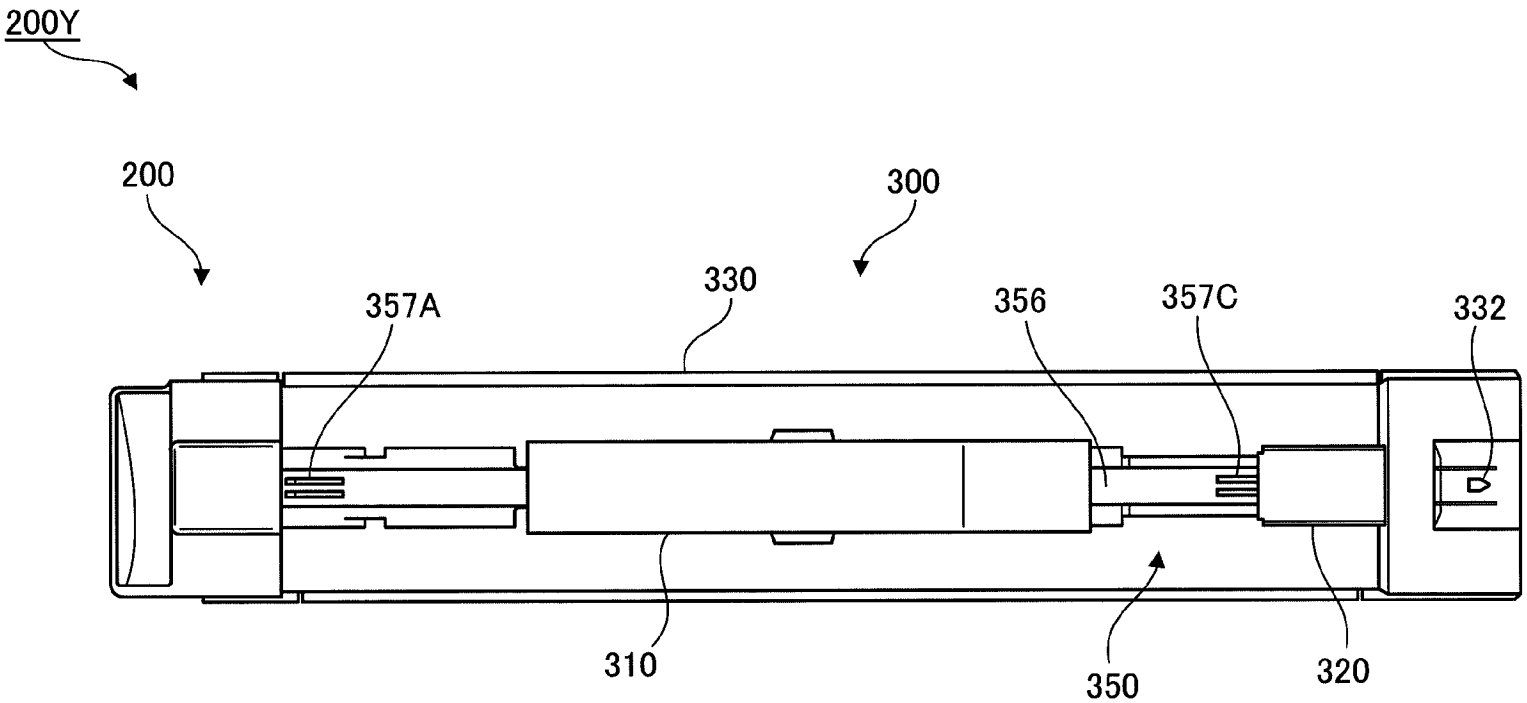
FIG. 12 is a view showing the powder cartridge in a state where the first shutter is opened, as viewed from the bottom portion side of the powder cartridge.
Figure 13:
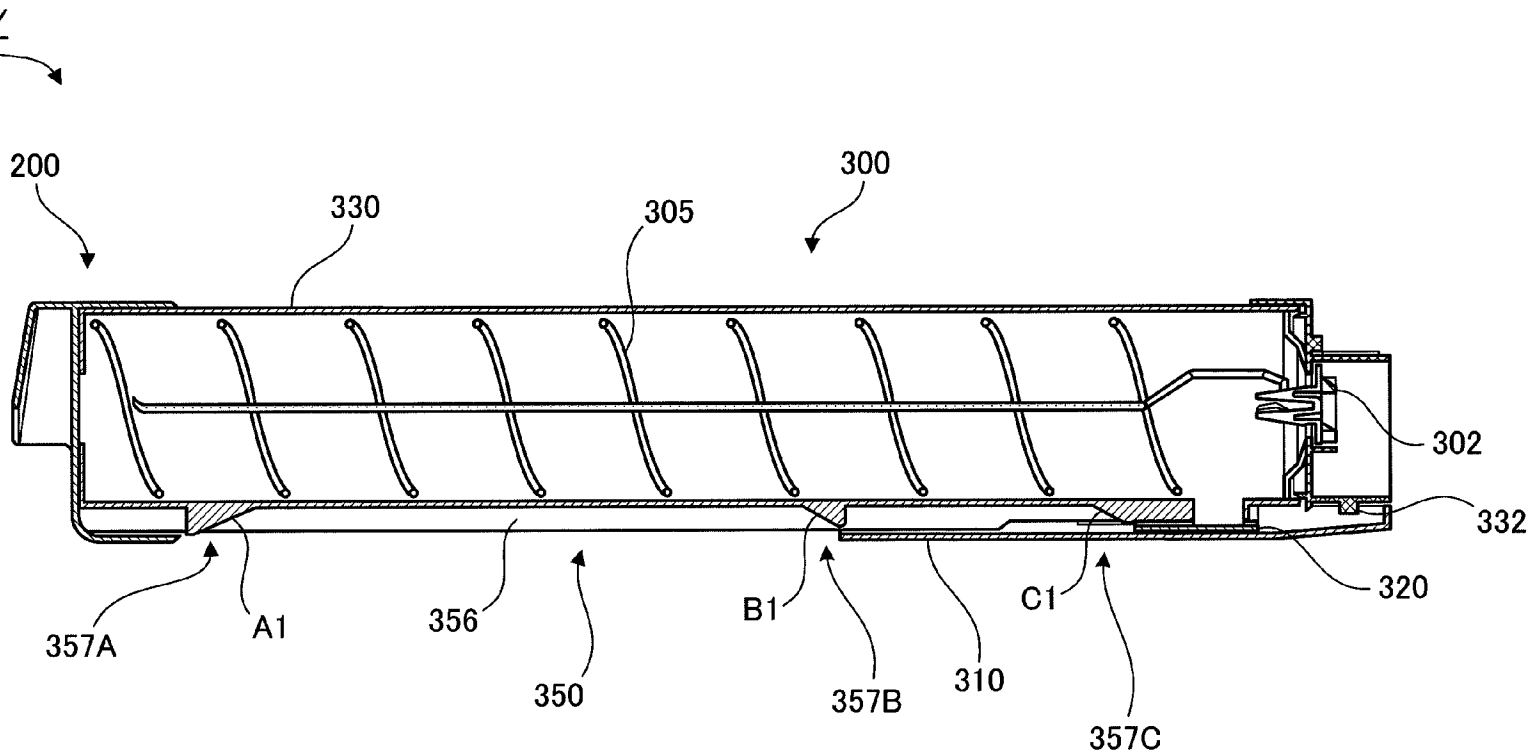
FIG. 13 is a cross-sectional view taken along the line XIII-XIII in FIG. 11.

FIG. 11 shows the powder cartridge 200Y in a state where the first shutter 310 is closed as viewed from the bottom portion side of the powder cartridge 200Y. FIG. 12 shows the powder cartridge 200Y in a state where the first shutter 310 is opened as viewed from the bottom portion side of the powder cartridge 200Y. FIG. 13 is a cross-sectional view of the powder cartridge 200Y taken along the line XIII-XIII in FIG. 11.

As shown in FIG. 11, in the shutter guide portion 350, a shutter guide groove 356 is formed along the axial direction of the powder cartridge 200Y. Inside the shutter guide groove 356, a first retraction portion 357A and a second retraction portion 357B are provided to press a first protrusion (described in detail later) provided to the accommodation portion 500 (refer to FIG. 3) to retract the first protrusion from a movement route of the powder cartridge 200Y. Moreover, as shown in FIG. 12, a third retraction portion 357C (an example of a retraction portion) is also provided inside the shutter guide groove 356 to press a second protrusion (described in detail later) provided to the accommodation portion 500 to retract the second protrusion from the movement route of the powder cartridge 200Y. Each of the first retraction portion 357A, the second retraction portion 357B and the third retraction portion 357C is formed to have plural (ribbed) protrusions like thin plates arranged in parallel with each other.

The first retraction portion 357A is provided to a side of the powder cartridge 200Y, where the operation portion 200 is provided. In the case where the powder cartridge 200Y is viewed from the bottom portion side thereof (in the state shown in FIG. 11), the first retraction portion 357A is provided adjacent to the operation portion 200.

The second retraction portion 357B is provided between the first retraction portion 357A and the third retraction portion 357C. The second retraction portion 357B is provided closer to the rear end portion of the powder cartridge 200Y than the first shutter 310 when the first shutter 310 is closed (refer to FIG. 11). Further, when the first shutter 310 is closed, the second retraction portion 357B is provided adjacent to the first shutter 310 (refer to FIG. 11).

The third retraction portion 357C is provided on the front end portion side of the powder cartridge 200Y. Further, when the second shutter 320 is closed, the third retraction portion 357C is provided closer to the rear end portion of the powder cartridge 200Y than the second shutter 320 (refer to FIG. 12). Further, as the powder cartridge 200Y is viewed from the bottom portion side thereof, the third retraction portion 357C is provided adjacent to the second shutter 320 (refer to FIG. 12).

As shown in FIG. 13, the first retraction portion 357A has a slope (an inclined surface) A1 that is formed to be apart from the outer circumferential surface (outer surface) of the base 330 along with a move toward the rear end portion side of the powder cartridge 200Y. In other words, the first retraction portion 357A has a slope inclined to the withdrawal direction of the powder cartridge 200Y. The second retraction portion 357B has a slope B1 that is formed to be apart from the outer circumferential surface of the base 330 along with a move toward the front end portion side of the powder cartridge 200Y. The third retraction portion 357C also has a slope C1 that is formed to be apart from the outer circumferential surface of the base 330 along with a move toward the front end portion side of the powder cartridge 200Y. FIG. 13 also shows the inside of the main body portion 300. Inside the main body portion 300, a transport member 305 is provided, which is driven to rotate on receiving the driving force from the connecting member 302 for transporting the powder inside the main body portion 300 to the powder discharge port 307 (refer to FIG. 10).

Next, the accommodation portion 500 and the powder transport portion 800 shown in FIG. 3 will be described.

Figure 14:
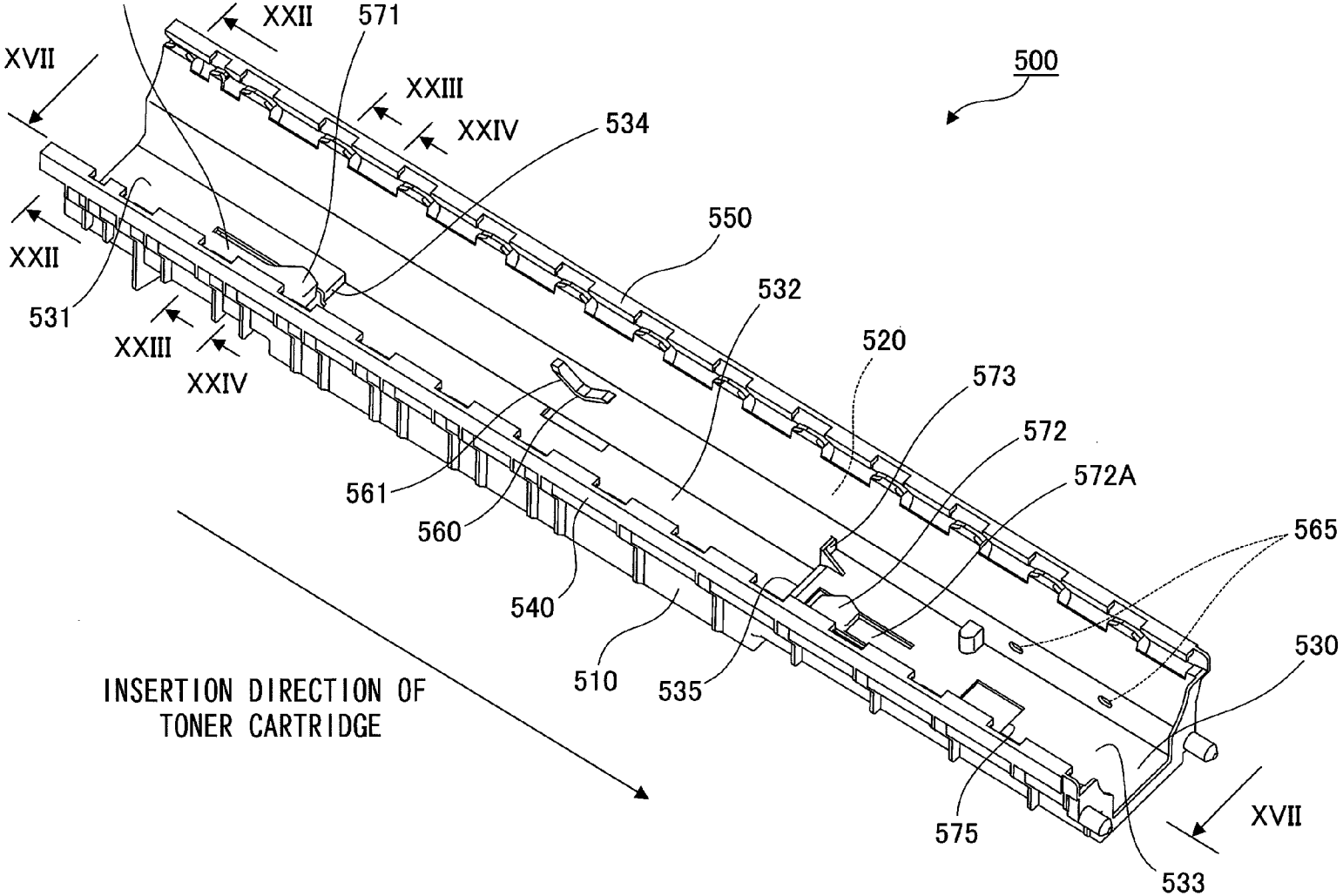
FIG. 14 is a perspective view showing an accommodation portion.

FIG. 14 is a perspective view of the accommodation portion 500.

As shown in the figure, the accommodation portion 500 is formed like a water shoot (formed to have a U-shaped cross section), that is, the upper portion thereof is opened. More specifically, the accommodation portion 500 has: a bottom portion 530 having a couple of long sides and extending in the direction of inserting the powder cartridge 200Y; a first side wall 510 extending upwardly from one of the couple of long sides of the bottom portion 530; and a second side wall 520 extending upwardly from the other long side of the bottom portion 530. The accommodation portion 500 has, on an upper edge of the first side wall 510, a first guide 540 into which one of the rotation regulation portions 340 (refer to FIG. 5A) formed on the powder cartridge 200Y is inserted, and which guides the one of the rotation regulation portions 340. The accommodation portion 500 further has, on an upper edge of the second side wall 520, a second guide 550 into which the other one of the rotation regulation portions 340 (refer to FIG. 5A) formed on the powder cartridge 200Y is inserted, and which guides the other one of the rotation regulation portions 340.

The accommodation portion 500 includes, on an inner surface of the second side wall 520, a V-shaped protrusion 560 having a slope 561 that approaches the bottom portion 530 along with proceeding in the insertion direction of the powder cartridge 200Y. Though illustration thereof is omitted, the protrusion 560 is also provided to an inner surface of the first side wall 510. Moreover, the accommodation portion has a couple of long holes 565 provided to pass through the second side wall 520. The couple of long holes 565 are provided in the back side of the accommodation portion 500 in the insertion direction of the powder cartridge 200Y. The couple of long holes 565 are also provided on the first side wall 510, although illustration thereof is omitted.

Here, the bottom portion 530 is provided with three flat surfaces arranged with displacement in a height direction. Specifically, in the bottom portion 530, a first flat surface 531 is provided near an inlet portion side where the insertion of the powder cartridge 200Y is started. At the back of the first flat surface 531, a second flat surface 532 that is positioned lower than the first flat surface 531 is provided. At the further back of the second flat surface 532, a third flat surface 533 is provided such that the third flat surface 533 is arranged higher than the first flat surface 531 and the second flat surface 532. A first connecting surface 534 arranged along the height direction to connect the first flat surface 531 and the second flat surface 532, and a second connecting surface 535 arranged along the height direction to connect the second flat surface 532 and the third flat surface 533 are also provided.

The accommodation portion 500 is also provided with the first protrusion 571 which is connected to the first flat surface 531 via an elastic piece 571A and protrudes from the first flat surface 531 to the movement route of the powder cartridge 200Y (first shutter 310). Also, the second protrusion 572 (an example of a protruding portion), which is connected to the third flat surface 533 via an elastic piece 572A and protrudes from the third flat surface 533 to the movement route of the powder cartridge 200Y, is provided. The first protrusion 571 is enabled to retract from the movement route of the powder cartridge 200Y by deflection of the elastic piece 571A, and the second protrusion 572 is also enabled to retract from the movement route of the powder cartridge 200Y by deflection of the elastic piece 572A.

Further, in the present exemplary embodiment, a regulation protrusion 573 is provided at a location above the second connecting surface 535 where the third flat surface 533 and the second side wall 520 is connected. The regulation protrusion 573 makes contact with the operation portion 200 (refer to FIG. 4) when the powder cartridge 200Y is inserted in a state where the front end and the rear end of the powder cartridge 200Y is reversed, thereby regulating the movement of the powder cartridge 200Y toward the backside beyond the position where the regulation protrusion 573 is provided. The accommodation portion 500 has a main body side discharge port 575 for further discharging powder having been discharged from the powder discharge port 307 (refer to FIG. 10) to the powder transport portion 800 (refer to FIG. 3).

The accommodation portion 500 will be further described.

Figure 15:
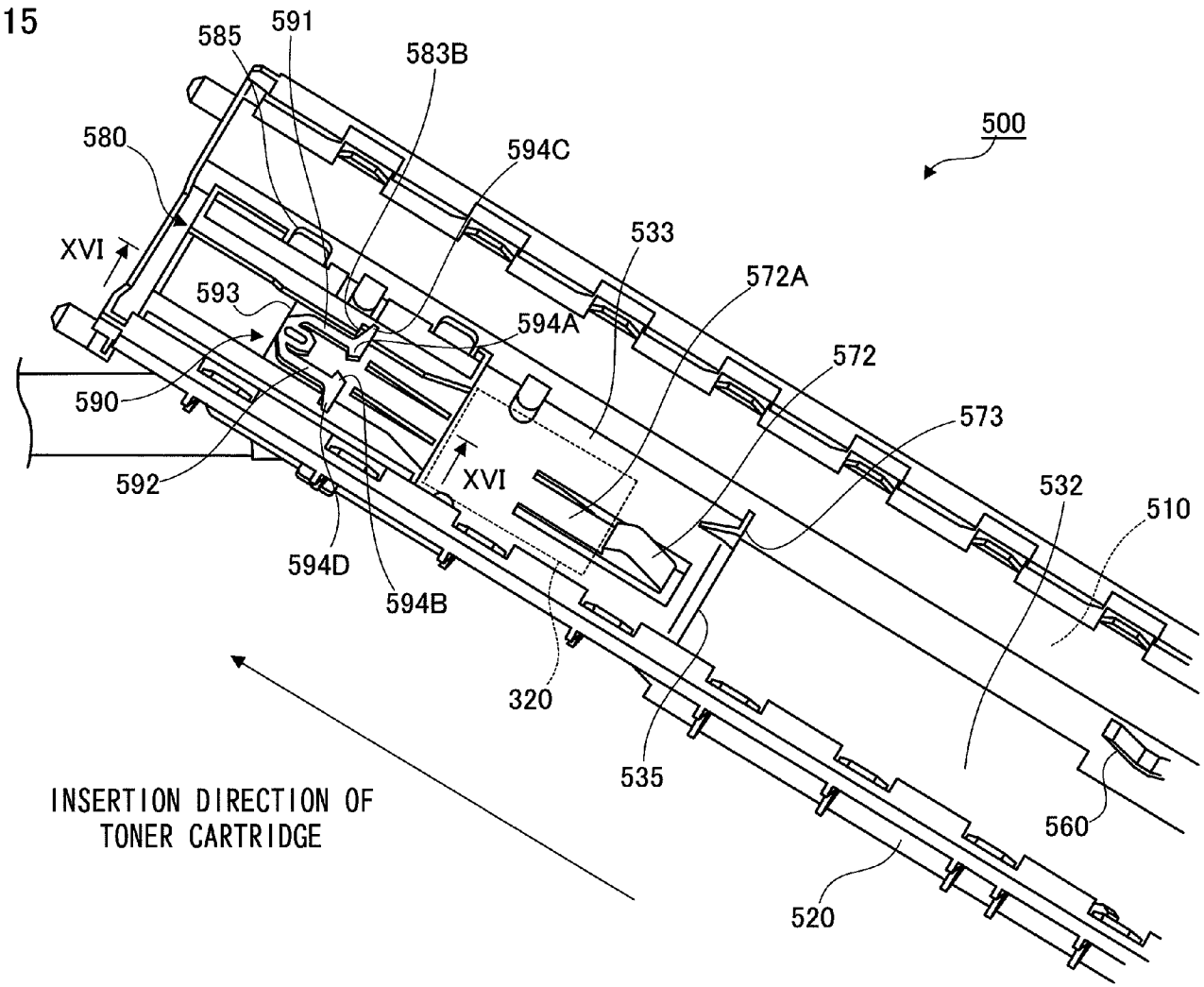
FIG. 15 is a view illustrating periphery of a third flat surface of the accommodation portion.

FIG. 15 illustrates periphery of the third flat surface 533 of the accommodation portion 500. Though explanation has been omitted in the above description, the accommodation portion 500 is provided with a slidable member 580 (an example of a releasing member and a regulation member) arranged backside than the second protrusion 572 in the insertion direction of the powder cartridge 200Y and above the third flat surface 533, which is slidable in the insertion direction and withdrawal direction of the powder cartridge 200Y. The accommodation portion 500 is also provided with a main body side shutter 590 that is attached to the slidable member 580 and slidable in the insertion direction and the withdrawal direction of the powder cartridge 200Y.

Figure 16:
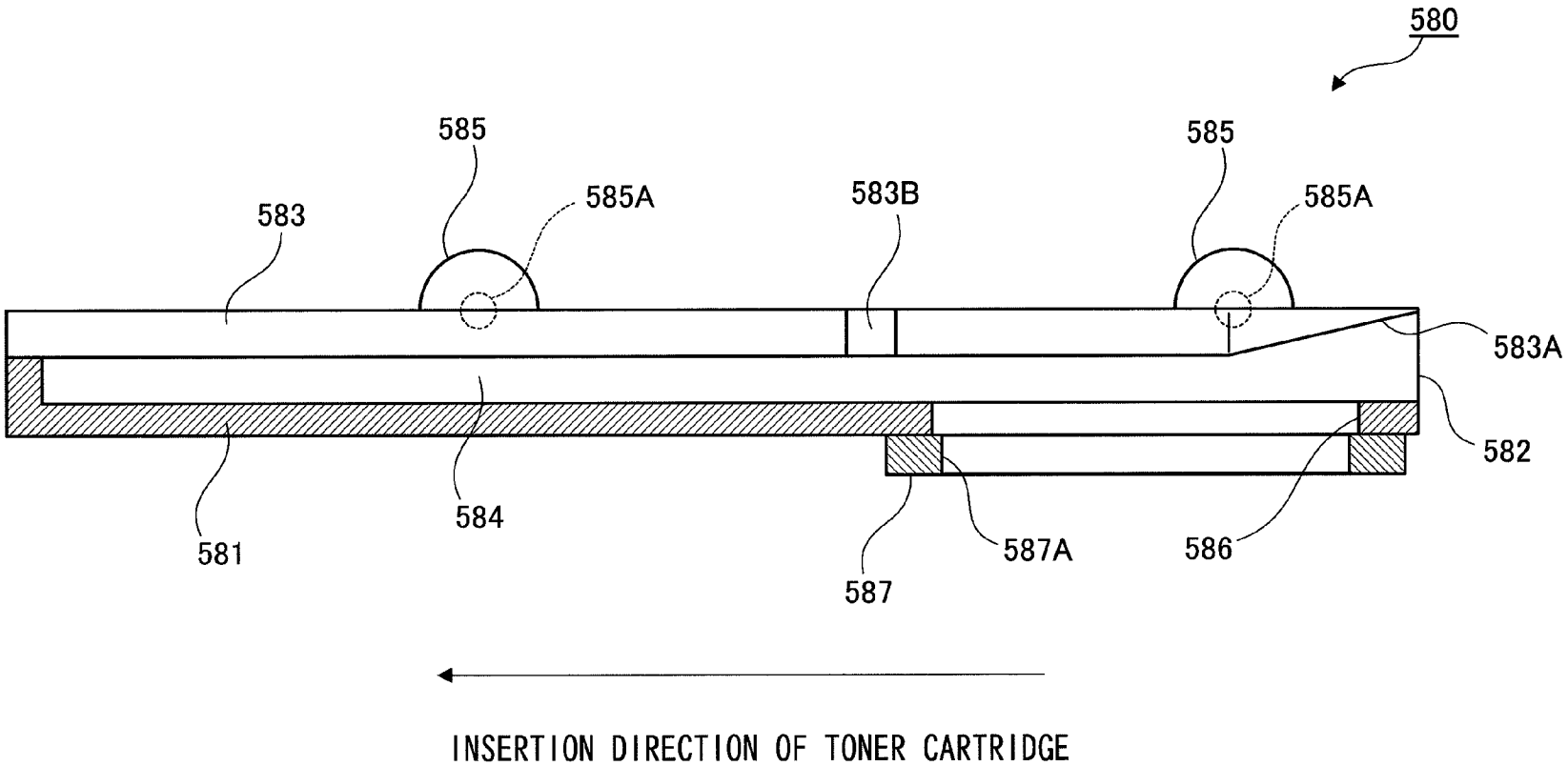
FIG. 16 is a cross-sectional view taken along the line XVI-XVI in FIG. 15.

FIG. 16 is a cross-sectional view taken along the line XVI-XVI in FIG. 15. First, the slidable member 580 will be explained with reference to FIGS. 15 and 16. In FIG. 16, illustration of the main body side shutter 590 is omitted.

As shown in FIG. 16, the slidable member 580 includes: a bottom plate 581 formed to be rectangular as seen in a top view; a side portion 582 arranged on one of the long sides of the bottom plate 581 and extending upwardly; and a facing portion 583 arranged to face the bottom plate 581 and is connected to the side portion 582. The slidable member 580 has a gap 584 between the bottom plate 581 and the facing portion 583. Though the illustration is omitted in FIG. 16, the side portion 582, the facing portion 583 and the gap 584 are provided on the other long side of the bottom plate 581.

Further, as also shown in FIG. 15, the slidable member 580 has a couple of facing pieces 585 on one of the long sides of the bottom plate 581, which are arranged to face the first side wall 510. As shown in FIG. 16, each of the facing pieces 585 is provided with a protrusion 585A that protrudes toward the first side wall 510. The protrusion 585A is inserted into the long hole 565 formed on the accommodation portion 500 (refer to FIG. 14). Though illustration in the figure is omitted, the couple of facing pieces 585 are provided to the other long side. The slidable member 580 includes, as shown in FIG. 16, a through hole 586 on the bottom plate 581, which is arranged to face the main body side discharge port 575 (refer to FIG. 14) to pass through the powder having been discharged from the powder cartridge 200Y.

In the slidable member 580, a sealing member 587 is put on a surface facing the third flat surface 533 (refer to FIG. 15) among the plural surfaces formed in the bottom plate 581 (refer to FIG. 16). The sealing member 587 has elasticity and is compressible in a thickness direction. The sealing member 587 may be formed of, for example, urethane rubber or foamed polyurethane. On the sealing member 587, a through hole 587A is formed to pass through the powder that has been passed through the through hole 586. Further, the slidable member 580 has a slope 583A that approaches the bottom plate 581 along with a move toward a downstream side of the insertion direction of the powder cartridge 200Y, the slope 583A being arranged on a surface facing the bottom plate 581 among the plural surfaces provided to the facing portion 583 and on an upstream side in the insertion direction of the powder cartridge 200Y. Moreover, a cutout 583B is formed on the facing portion 583 of the slidable member 580 (also, refer to FIG. 15).

Meanwhile, the main body side shutter 590 has a shutter main body 593, which is contained within the gap 584 of the slidable member 580 and is slidable in the insertion direction and the withdrawal direction of the powder cartridge 200Y, and a first swing piece 591 swingable in an approaching direction and a separating direction with respect to one of the two facing portions 583. A second swing piece 592 is also provided, which is swingable in an approaching direction and a separating direction with respect to the other one of the two facing portions 583. The first swing piece 591 and the second swing piece 592 are fastened to the upper surface of the shutter main body 593.

The main body side shutter 590 has a first protrusion 594A at a part of the first swing piece 591 facing the second swing piece 592, and a second protrusion 594B at a part of the second swing piece 592 facing the first swing piece 591. Further, the main body side shutter 590 has a third protrusion 594C which enters into the cutout 583B formed on one of the facing portions 583 when facing the cutout 583B, and a fourth protrusion 594D which enters into the cutout 583B formed on the other one of the facing portions 583 when facing the cutout 583B.

Figure 17:
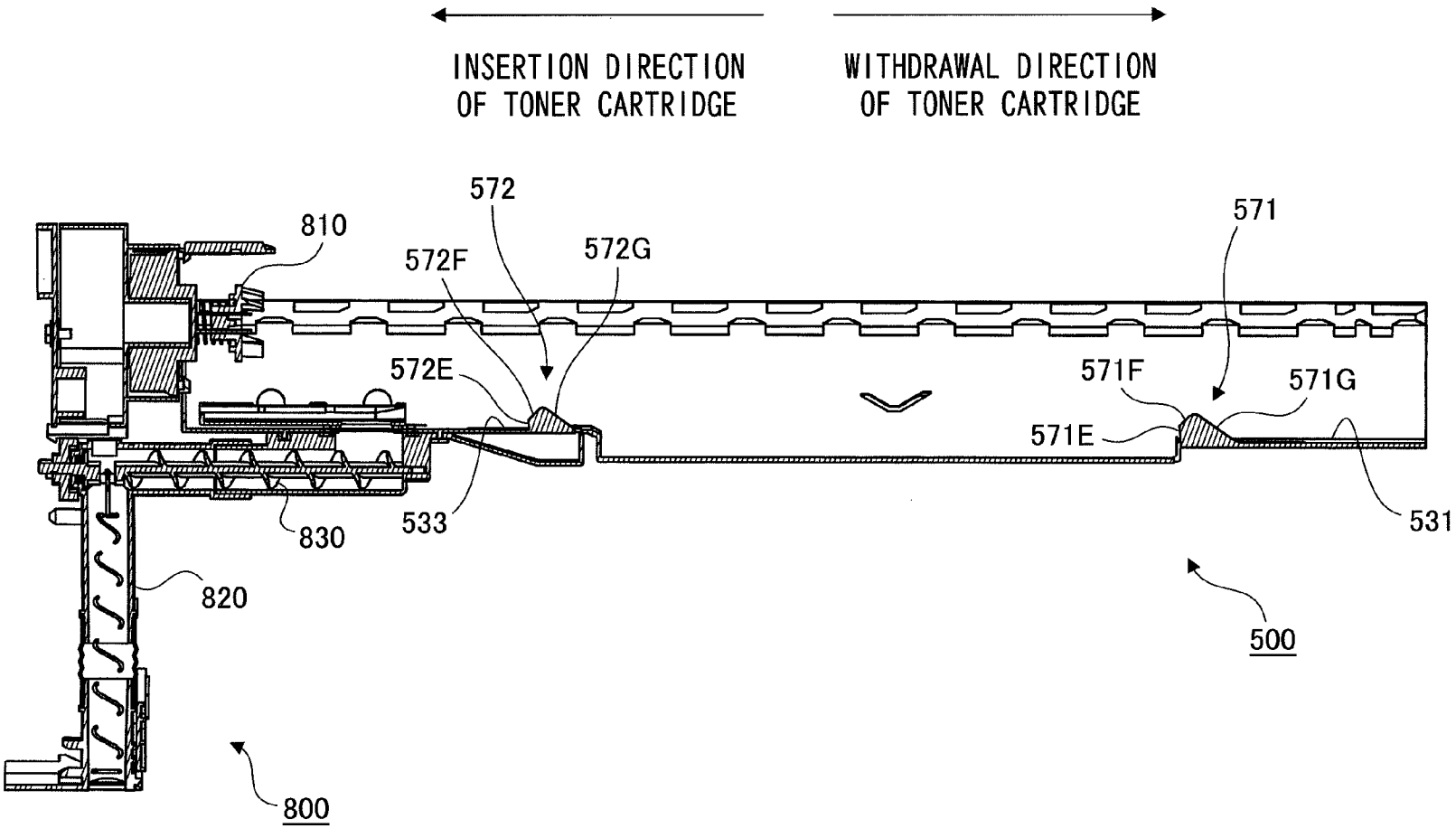
FIG. 17 is a cross-sectional view taken along the line XVII-XVII in FIG. 14.

FIG. 17 is a cross-sectional view taken along the line XVII-XVII in FIG. 14. The accommodation portion 500 will be further described using the figure. In the figure, the slidable member 580 and the main body side shutter 590 are also illustrated.

As shown in the figure, each of the first protrusion 571 and the second protrusion 572 has a triangular cross-section. More specifically, the first protrusion 571 has a regulation surface 571E arranged in an orthogonal relationship (intersecting relationship) to the insertion direction (withdrawal direction) of the powder cartridge 200Y to regulate the backward movement of the first shutter 310 (refer to FIG. 10). The first protrusion 571 also includes a first slope 571 F which is connected to the regulation surface 571E and is directed upwardly (in a direction away from the first flat surface 531) along with proceeding in the withdrawal direction of the powder cartridge 200Y, and a second slope 571 G which is connected to the first slope 571 F and is directed downwardly (in a direction approaching the first flat surface 531) along with proceeding in the withdrawal direction of the powder cartridge 200Y.

The second protrusion 572 has a regulation surface 572E arranged in an orthogonal relationship (intersecting relationship) to the insertion direction (withdrawal direction) of the powder cartridge 200Y to regulate the backward movement of the second shutter 320 (refer to FIG. 10). The second protrusion 572 also includes a first slope 572F which is connected to the regulation surface 572E and is directed upwardly (in a direction away from the third flat surface 533) along with proceeding in the withdrawal direction of the powder cartridge 200Y, and a second slope 572G which is connected to the first slope 572F and is directed downwardly (in a direction approaching the third flat surface 533) along with proceeding in the withdrawal direction of the powder cartridge 200Y.

In FIG. 17, the powder transport portion 800 is also illustrated. The powder transport portion 800 includes: a connected member 810 to which the connecting member 302 (refer to FIG. 5A) provided to the powder cartridge 200Y and which drives to rotate the connecting member 302; a motor (not shown) that drives to rotate the connected member 810; a cylindrical member 820 constituting a transport path of the powder; and a transport member 830 which is held in the cylindrical member 820 to transport the powder.

Next, operation of each portion when the powder cartridge 200Y is inserted or pulled out will be explained.

Figure 18:
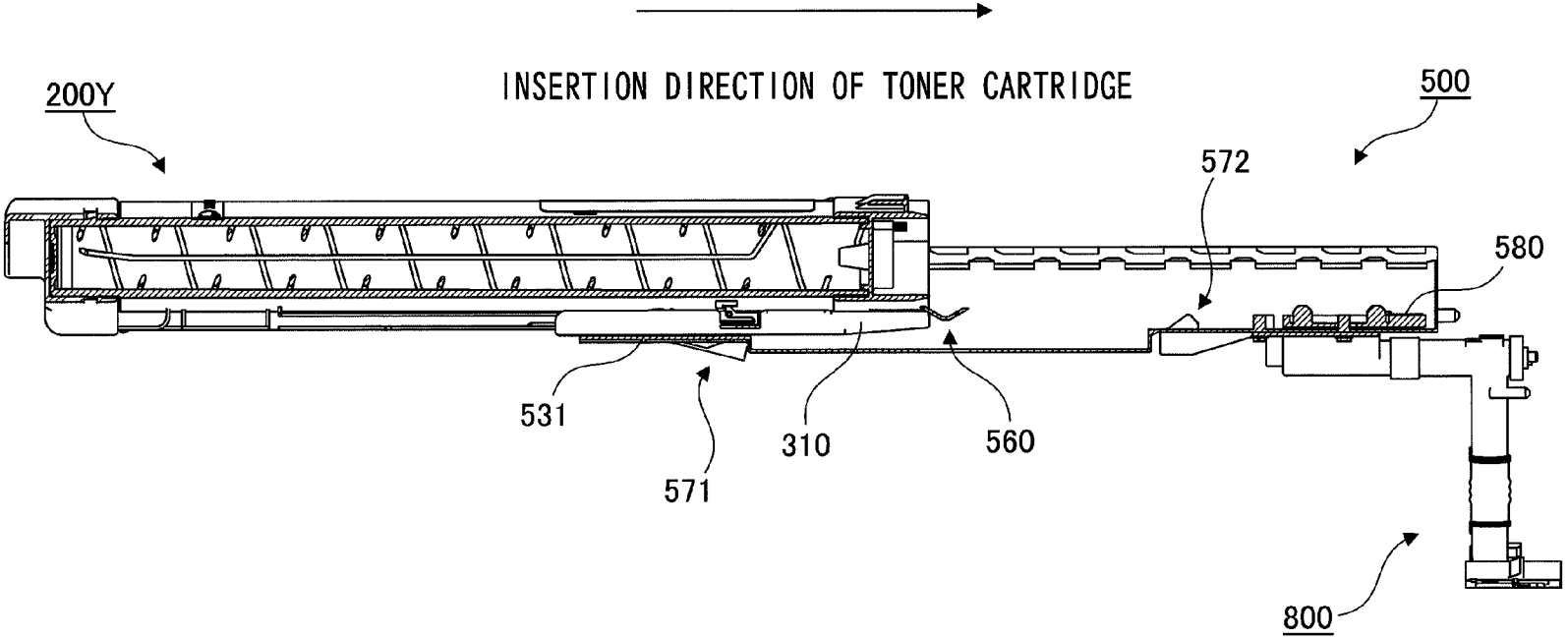
FIG. 18 is a view showing a state of each portion immediately after the insertion of the powder cartridge is started.

FIG. 18 is a view showing a state of each portion immediately after the insertion of the powder cartridge 200Y is started. In the case where the powder cartridge 200Y is inserted into the image forming apparatus 1, the first shutter 310 passes through over the first flat surface 531. On this occasion, the second slope 571G (refer to FIG. 17) is pressed by the first shutter 310, and thus the first protrusion 571 moves toward the lower surface side of the first flat surface 531. In other words, the first protrusion 571 is retracted from the movement route of the powder cartridge 200Y not to block the movement of the powder cartridge 200Y. When the powder cartridge 200Y is inserted, the rotation regulation portions 340 (refer to FIG. 5A) of the powder cartridge 200Y are inserted into the first guide 540 and the second guide 550 (refer to FIG. 14). Accordingly, the powder cartridge 200Y moves along the predetermined route.

Figure 19:
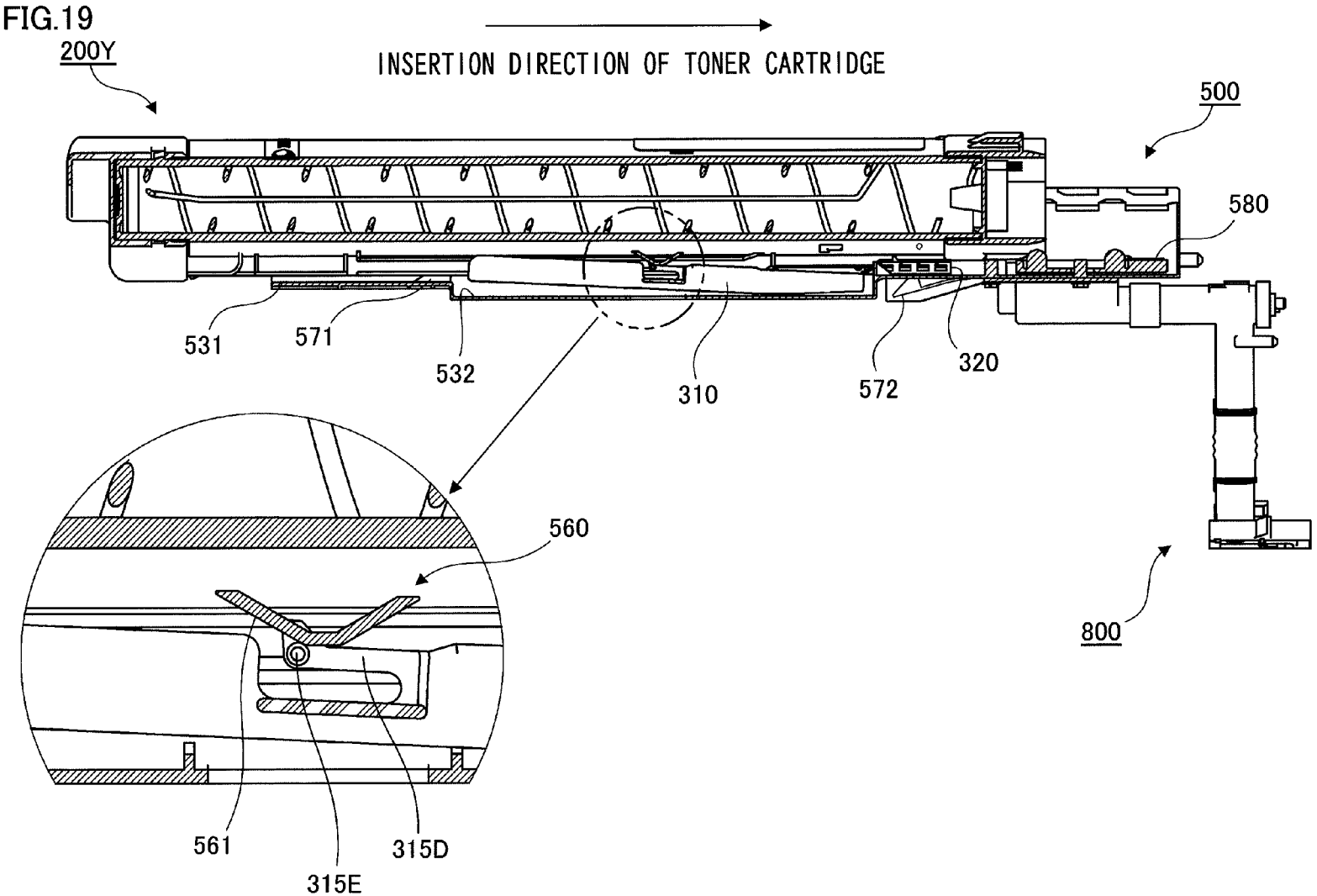
FIG. 19 is a view illustrating a state of each portion halfway through the insertion of the powder cartridge.

When the powder cartridge 200Y is further inserted from the state shown in FIG. 18, the first shutter 310 passes through the first protrusion 571 as shown in FIG. 19 (a view illustrating a state of each part halfway through the insertion of the powder cartridge 200Y). Consequently, the first protrusion 571 protrudes on the movement route of the powder cartridge 200Y. On this occasion, the first protrusion 571 protrudes within the shutter guide groove 356 (refer to FIG. 11) provided on the shutter guide portion 350. After the first shutter 310 passes through the first protrusion 571, the fourth protrusion 315E of the first shutter 310 strikes the slope 561 of the protrusion 560 provided on the accommodation portion 500 side, and thus proceeding of the first shutter 310 is regulated. The fourth protrusion 315E is pressed from above by the slope 561, thereby releasing the striking of the fourth protrusion 315E against the regulation protrusion 303, as explained by use of FIG. 7.

Figure 20:
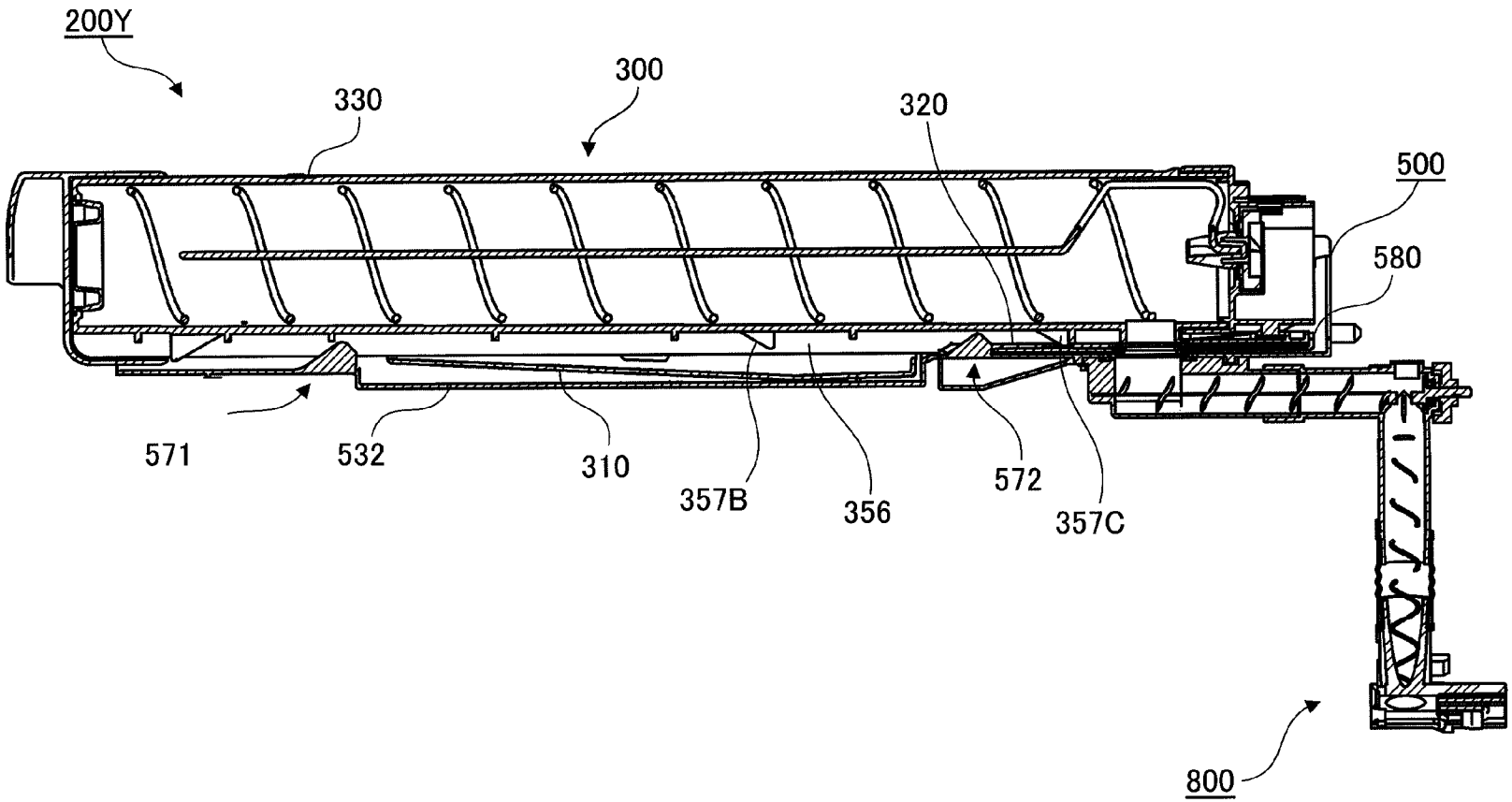
FIG. 20 is a view illustrating a state of each portion after the insertion of the powder cartridge is completed.

Thereafter, striking between the upper edge portion 321 (refer to FIG. 7) and the third protrusion 315C (refer to FIG. 6) is disengaged, and the first shutter 310 goes into the state where the front end portion thereof hangs down as described above. Then the first shutter 310 is in a state of being held above the second flat surface 532 as shown in FIG. 19. When the powder cartridge 200Y further proceeds from the state shown in FIG. 18, the second slope 572G of the second protrusion 572 (refer to FIG. 17) is pressed by the second shutter 320, and thus the second protrusion 572 is temporarily retracted from the movement route of the powder cartridge 200Y as shown in FIG. 19. When insertion of the powder cartridge 200Y is completed, as shown in FIG. 20 (a view illustrating a state of each part after insertion of the powder cartridge 200Y is completed), the second protrusion 572 protrudes again on the movement route of the powder cartridge 200Y. On this occasion, the second protrusion 572 protrudes within the shutter guide groove 356 (also, refer to FIG. 11), as described above.

Further, when the powder cartridge 200Y is inserted, the protrusion 332 (refer to FIGS. 12 and 13) provided on the front end portion of the powder cartridge passes between the first protrusion 594A and the second protrusion 594B provided to the main body side shutter 590 (refer to FIG. 15). Thereby, the protrusion 332 goes into a state to be held in a region surrounded by the first swing piece 591 and the second swing piece 592. In the present exemplary embodiment, as the powder cartridge 200Y proceeds, the first protrusion 353 (refer to FIG. 9), the second protrusion 354 and the sealing member 304 enter into the inside of the gap 584 (refer to FIG. 16) formed on the slidable member 580. On this occasion, the sealing member 304 is compressed in the thickness direction. Upon entering of the first protrusion 353, the second protrusion 354 and the sealing member 304 into the inside of the gap 584, an end surface of the shutter main body 593 (refer to FIG. 15) is pressed by these members, thereby moving the main body side shutter 590 forward. Accordingly, the main body side discharge port 575 (refer to FIG. 14) is opened.

When the end surface of the shutter main body 593 is pressed and the main body side shutter 590 moves forward, the third protrusion 594C and the fourth protrusion 594D having positioned in the cutout 583B (refer to FIG. 15) come to be pressed by the facing portion 583 (refer to FIG. 16). As a result, the first swing piece 591 and the second swing piece 592 are elastically deformed, and thus the first protrusion 594A and the second protrusion 594B approach each other. As the first protrusion 594A and the second protrusion 594B approach, the protrusion 332 of the powder cartridge 200Y strikes these protrusions when the powder cartridge 200Y is pulled out. This results in that the main body side shutter 590 is closed when the powder cartridge 200Y is pulled out.

In the present exemplary embodiment, the bottom plate 581 of the slidable member 580 (refer to FIG. 16) is positioned on the movement route of the second shutter 320. Therefore, after passing through the second protrusion 572 (refer to FIG. 15), the second shutter 320 having moved along with insertion of the powder cartridge 200Y comes to strike the slidable member 580, and thus the movement thereof is regulated. Consequently, in the present exemplary embodiment, the second shutter 320 is in a state to be held between the slidable member 580 and the second protrusion 572 upon completing insertion of the powder cartridge 200Y. That is, the second shutter 320 comes to a state to be held in a location indicated by the broken line in FIG. 15. In addition, the second shutter 320 relatively moves against the base 330 of the main body portion 300 by striking the slidable member 580, thereby opening the powder discharge port 307.

Next, operation of each portion when the powder cartridge 200Y is pulled out will be explained. In the case where withdrawal of the powder cartridge 200Y is started from the state shown in FIG. 20, movement (backward movement) of the main body portion 300 is started first. On this occasion, the protrusion 332 (refer to FIGS. 12 and 13) strikes the first protrusion 594A and the second protrusion 594B of the main body side shutter 590, and thus the main body side shutter 590 moves together with the main body portion 300. Accordingly, the through hole 586 (refer to FIG. 16) of the slidable member 580 is closed. After the through hole 586 of the slidable member 580 is closed, the third protrusion 594C and the fourth protrusion 594D reach the cutout 583B (refer to FIG. 15) as the main body shutter 590 further moves. Therefore, a gap between the first protrusion 594A and the second protrusion 594B becomes wider, thus allowing the protrusion 332 to pass between the first protrusion 594A and the second protrusion 594B.

Immediately after withdrawal of the powder cartridge 200Y is started, an end portion of the second shutter 320 strikes the regulation surface 572E of the second protrusion 572 (refer to FIG. 17) as an example of a closing portion, accordingly, the movement of the second shutter 320 is regulated. Consequently, along with the withdrawal operation of the powder cartridge 200Y, the powder discharge port 307 (refer to FIG. 10) approaches the second shutter 320, and thus the powder discharge port 307 is closed by the second shutter 320. In the present exemplary embodiment, after the powder discharge port 307 is closed by the second shutter 320, the third retraction portion 357C (refer to FIGS. 13 and 20) makes contact with the first slope 572F (refer to FIG. 17) of the second protrusion 572. Accordingly, the second protrusion 572 is retracted from the movement route of the second shutter 320, and the second shutter 320 then passes through the second protrusion 572.

Figure 21A:
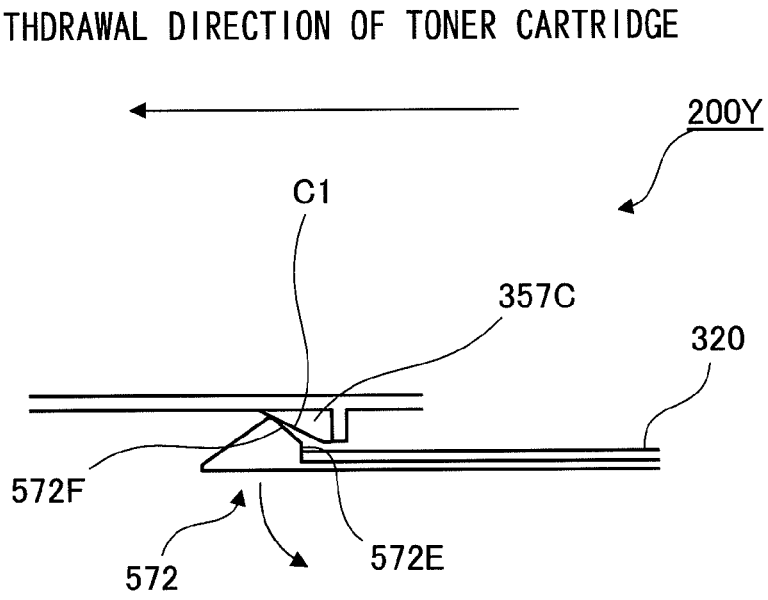
FIGS. 21A and 21B are views for illustrating operation of a second protrusion.

Operation of the second protrusion 572 will be described in more detail with reference to FIGS. 21A and 21 B (views for illustrating the operation of the second protrusion 572). As shown in FIG. 21A, a slope C1 of the third retraction portion 357C provided to the powder cartridge 200Y makes contact with the first slope 572F of the second protrusion 572. Thereby, the second protrusion 572 moves in a direction shown by an arrow in the figure. Thereafter, a left end portion (in the figure) of the second shutter 320 further presses the first slope 572F, and the second protrusion 572 further moves in the direction shown by the arrow in the figure. Accordingly, the second protrusion 572 is retracted from the movement route of the second shutter 320, and the second shutter 320 passes through the second protrusion 572.

In the case where withdrawal of the powder cartridge 200Y is performed, backward movement of the first shutter 310 is also regulated. More specifically, when withdrawal of the powder cartridge 200Y is performed, an end portion of the first shutter 310 strikes the regulation surface 571 E (refer to FIG. 17) of the first protrusion 571. Consequently, backward movement of the first shutter 310 is regulated, and the first shutter 310 comes to relatively move against the main body portion 300. When backward movement is regulated, the first shutter 310 is in a state to rest above the second flat surface 532 (refer to FIG. 14).

Here, when the second shutter 320 approaches the first shutter 310 whose backward movement is regulated, the third protrusion 315C (refer to FIG. 6) of the first shutter 310 runs upon the slope 326 (refer to FIG. 8) formed on the second shutter 320. Accordingly, the front end portion of the first shutter 310 approaches the outer circumferential surface of the base 330 of the powder cartridge 200Y. Thereafter, the fourth protrusion 315E (refer to FIG. 7) comes to position forward of the regulation protrusion 303 (refer to FIG. 7), and the first shutter 310 is fastened to the base 330. In the present exemplary embodiment, after the fourth protrusion 315E positions forward of the regulation protrusion 303, that is, after the first shutter 310 is fastened to the base 330, the second retraction portion 357B (refer to FIGS. 11 and 13) presses the first slope 571F (refer to FIG. 17) of the first protrusion 571. Consequently, the first protrusion 571 is retracted from the movement route of the first shutter 310. Then the first shutter 310 passes through the first protrusion 571, and thus withdrawal of the powder cartridge 200Y is completed.

Figure 21B:
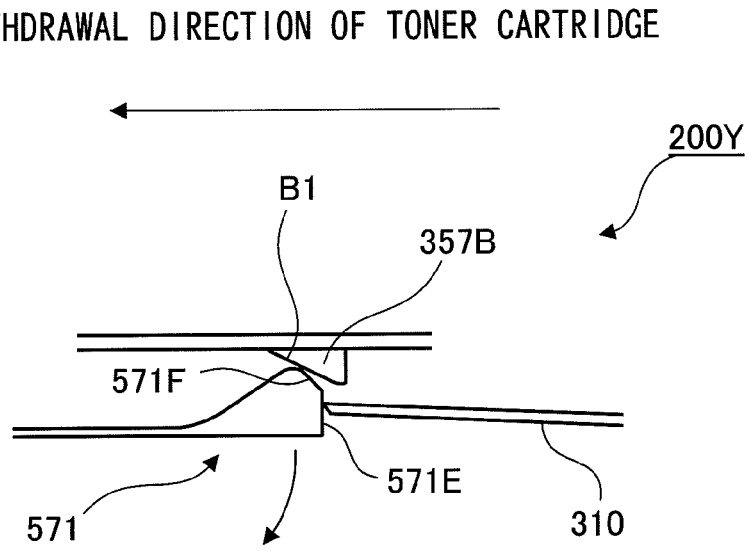

As the operation of the first protrusion 571 will be described more specifically with reference to FIGS. 21A and 21B, along with the withdrawal operation of the powder cartridge 200Y, the slope B1 of the second retraction portion 357B provided to the powder cartridge 200Y makes contact with the first slope 571F of the first protrusion 571. After that the left end portion in the figure of the first shutter 310 presses the first slope 571F as shown in FIG. 21B, and thereby the first protrusion 571 further moves in the direction of an arrow in the figure. Accordingly, the first protrusion 571 is retracted from the movement route of the first shutter 310, and the first shutter 310 passes through the first protrusion 571.

The operation of the second shutter 320 and the slidable member 580 when the powder cartridge 200Y is inserted into the image forming apparatus 1 and the operation of the second shutter 320 and the slidable member 580 when the powder cartridge 200Y is pulled out will be described in more detail. FIGS. 22 to 27 are views for illustrating the operation of the second shutter 320 and the slidable member 580.

Figure 22:
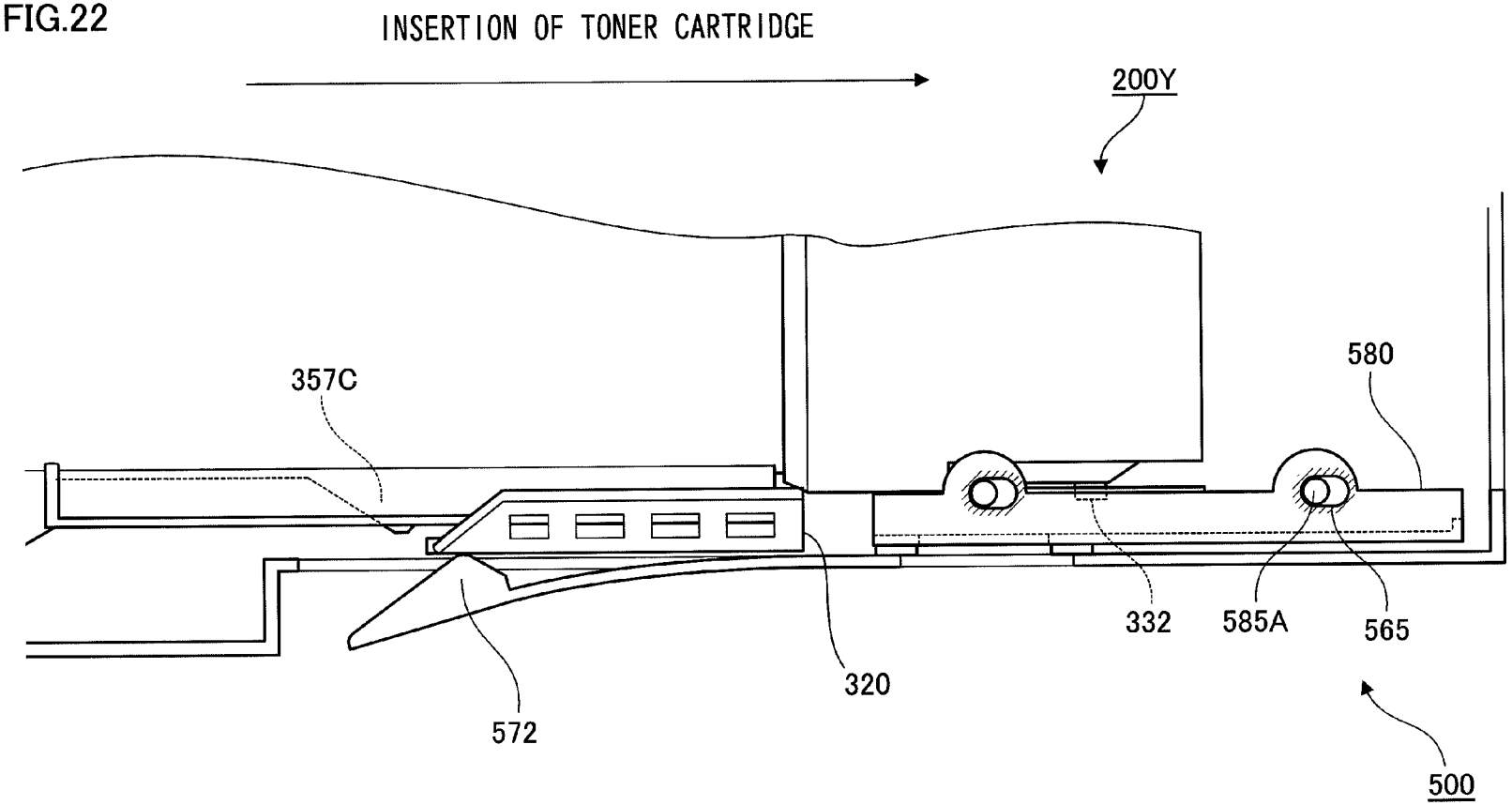
FIGS. 22 to 27 are views for illustrating operation of a second shutter and a slidable member.

When the powder cartridge 200Y inserted into the image forming apparatus 1 reaches the predetermined location, as shown in FIG. 22, the second protrusion 572 is pressed from above by the second shutter 320, and is retracted from the movement route of the powder cartridge 200Y.

Figure 23:
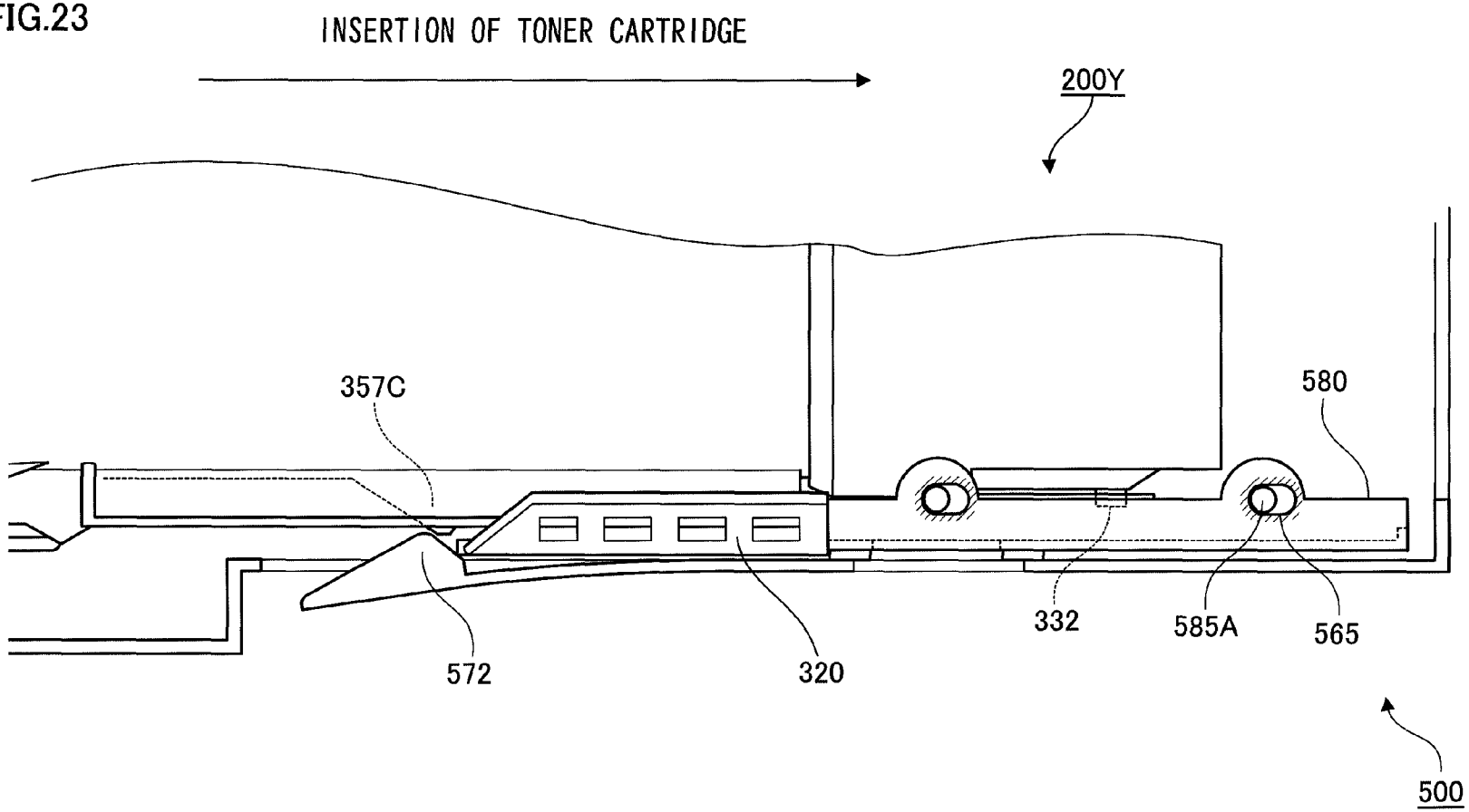

Meanwhile, the second shutter 320 moves toward the slidable member 580 by the insertion of the powder cartridge 200Y. Thereafter, as shown in FIG. 23, the second shutter 320 makes contact with an end portion of the slidable member 580. Accordingly, the slidable member 580 comes to be pressed toward a downstream side in the moving direction of the powder cartridge 200Y.

Figure 24:
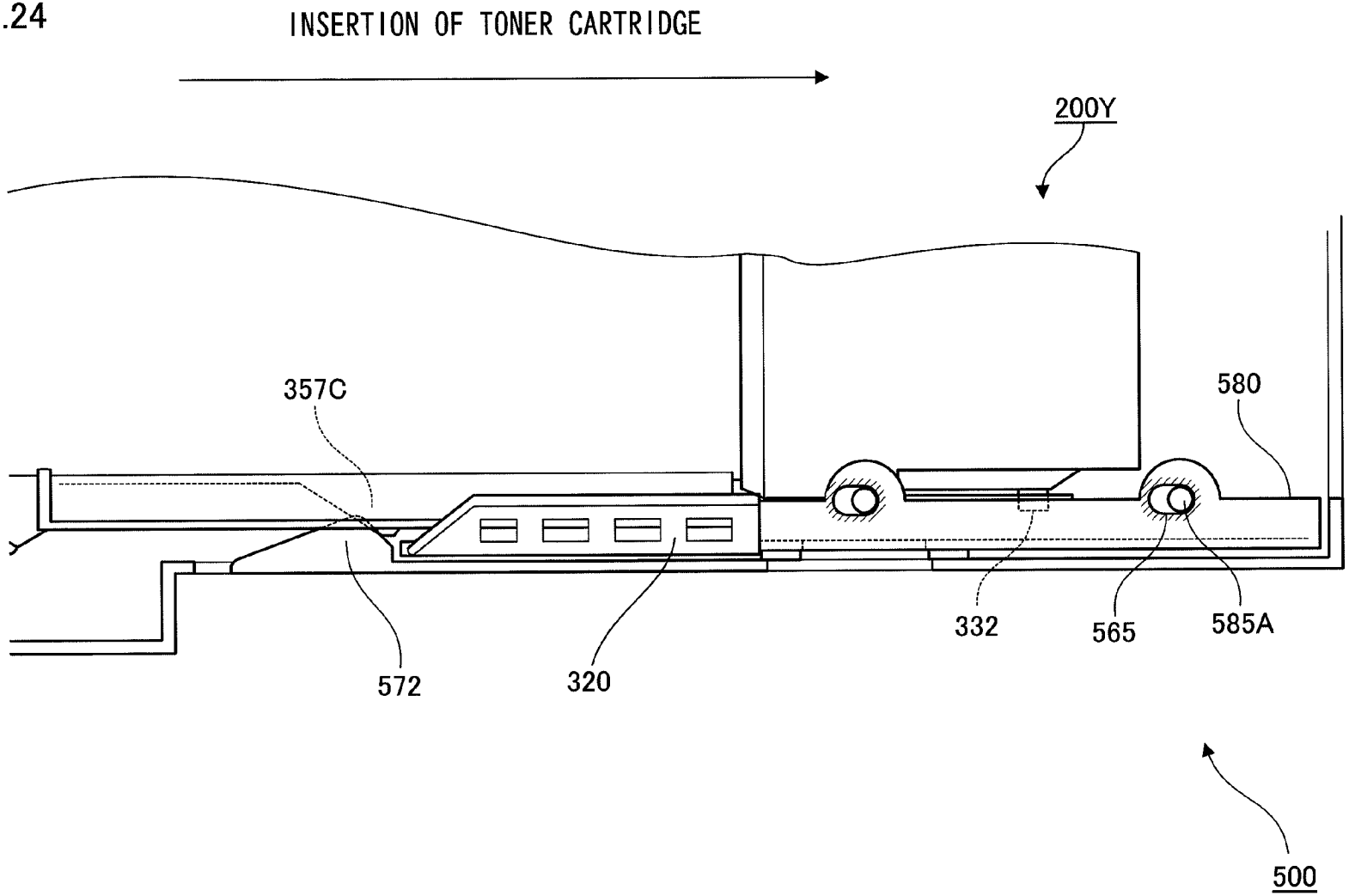

When the powder cartridge 200Y is further inserted, the slidable member 580 pressed by the second shutter 320 moves toward the downstream side in the moving direction of the powder cartridge 200Y. Thereafter, as shown in FIG. 24, the protrusion 585A provided to the slidable member 580 strikes an end portion of the long hole 565 (also refer to FIG. 14) formed on the accommodation portion 500, and thus the slidable member 580 stops moving. On this occasion, the second shutter 320 has passed through the second protrusion 572, and thereby the second protrusion 572 protrudes on the movement route of the powder cartridge 200Y (the second shutter 320).

Figure 25:
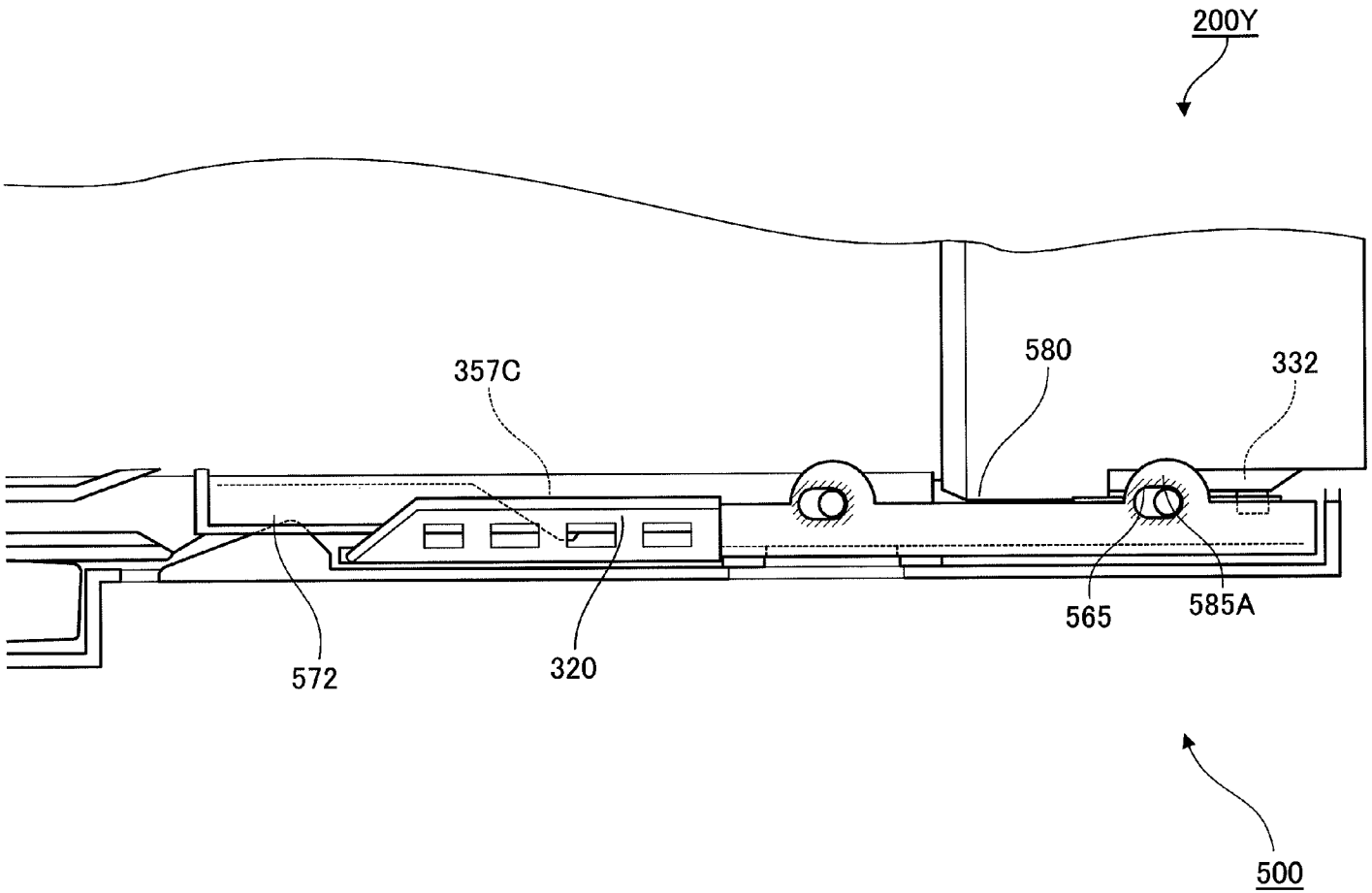

Thereafter, insertion of the powder cartridge 200Y is further performed, and as shown in FIG. 25, the protrusion 332 provided to the front end portion of the powder cartridge 200Y still moves. When insertion of the powder cartridge 200Y is further performed from the state shown in FIG. 24, the first protrusion 353 and the second protrusion 354 (refer to FIG. 9) provided to the powder cartridge 200Y enter into the gap 584 (an example of a groove) formed between the bottom plate 581 (refer to FIG. 16) and the facing portion 583 along the insertion direction of the powder cartridge 200Y. The sealing member 304 also enters into the gap 584. Consequently, the through hole 586 (refer to FIG. 16) formed on the slidable member 580 is opened, as well as the main body side shutter 590 (refer to FIG. 15) moves.

The sum of the thickness of the first protrusion 353 and the thickness of the sealing member 304 under natural conditions is larger than the size of the gap 584 (the same holds for the second protrusion 354). Accordingly, when the first protrusion 353 and the sealing member 304 enter into the gap 584, the sealing member 304 is compressed (the same holds for the second protrusion 354). Meanwhile, a frictional force is exerted between the first protrusion 353 and the slidable member 580 (a wall surface provided to the slidable member that faces the gap 584), and between the sealing member 304 and the slidable member 580.

When insertion of the powder cartridge 200Y is further performed from the state shown in FIG. 24, the powder discharge port 307 (refer to FIG. 10) provided to the powder cartridge 200Y comes to position above the through hole 586 (refer to FIG. 16) provided to the slidable member 580. Thereby, supply of the powder contained in the powder cartridge 200Y to the powder transport portion 800 (refer to FIG. 3) is made available. In the present exemplary embodiment, during the insertion of the powder cartridge 200Y, the second shutter 320 is in a state to be pressed by the slidable member 580, thus preventing formation of a gap between the second shutter 320 and the slidable member 580.

Next, the operation of withdrawal of the powder cartridge 200Y will be explained.

Figure 26:
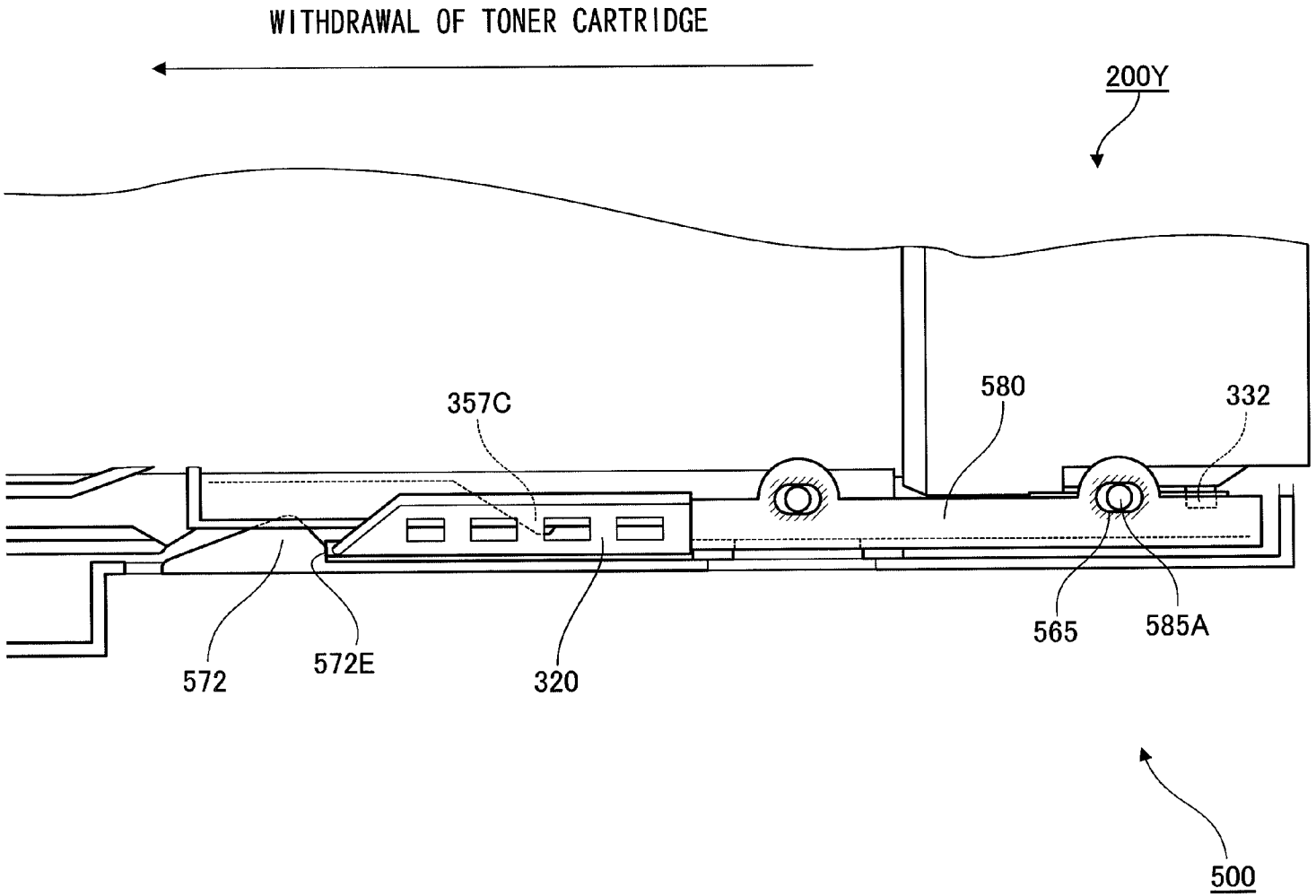

When withdrawal of the powder cartridge 200Y is started, the second shutter 320 moves in association with movement of the powder cartridge 200Y, and as shown in FIG. 26, an end portion of the second shutter 320 strikes the regulation surface 572E of the second protrusion 572. Accordingly, movement of the second shutter 320 is temporarily regulated. The reason why the second shutter 320 moves in association with movement of the powder cartridge 200Y is that the sealing member 304 (refer to FIG. 9) is provided in a state of being compressed in the thickness direction, and thereby a restoring force of the sealing member 304 is exerted between the first facing portion 324 and the first protrusion 353, and between the second facing portion 325 and the second protrusion 354.

In the present exemplary embodiment, as described above, the frictional force is exerted between the first protrusion 353 (refer to FIG. 9) and the slidable member 580 (the same holds for the second protrusion 354), and between the sealing member 304 (refer to FIG. 9) and the slidable member 580. As a result, in the present exemplary embodiment, the slidable member 580 is in a state to be held by the powder cartridge 200Y. Consequently, when the powder cartridge 200Y is pulled out, the slidable member 580 moves in association with the powder cartridge 200Y. In this case, the slidable member 580 moves to follow the movement of the second shutter 320, thus preventing formation of a gap between the second shutter 320 and the slidable member 580, as shown in FIG. 26. In other words, the slidable member 580 moves to follow the movement of the second shutter 320 while maintaining the contact with the second shutter 320. As will be more described, in the present exemplary embodiment, the slidable member 580 is pressed against the second shutter 320 whose movement is regulated by the second protrusion 572. The first protrusion 353, the second protrusion 354 and the sealing member 304 provided to the powder cartridge 200Y may be captured as a moving unit or a moving portion that moves the slidable member 580 (an example of the releasing member and the regulation member) in the withdrawal direction of the powder cartridge 200Y.

Here, if the gap is formed between the second shutter 320 and the slidable member 580 (the part regulating movement of the second shutter 320) in pulling out the powder cartridge 200Y, the powder fallen from the powder discharge port 307 (refer to FIG. 10) enters the gap when the powder discharge port 307 passes above the gap afterwards. Upon repeating the operation of insertion and withdrawal of the powder cartridge 200Y, the powder comes to accumulate in the gap. If a new powder cartridge Y is inserted in a state where the powder has accumulated in the gap, the powder accumulated in the gap adheres to the front end portion, such as the second shutter 320, of the powder cartridge 200Y. Therefore, in the present exemplary embodiment, the slidable member 580 is made to follow the second shutter 320 which moves in the withdrawal direction of the powder cartridge 200Y, thus preventing occurrence of the gap between the second shutter 320 and the slidable member 580.

Figure 27:
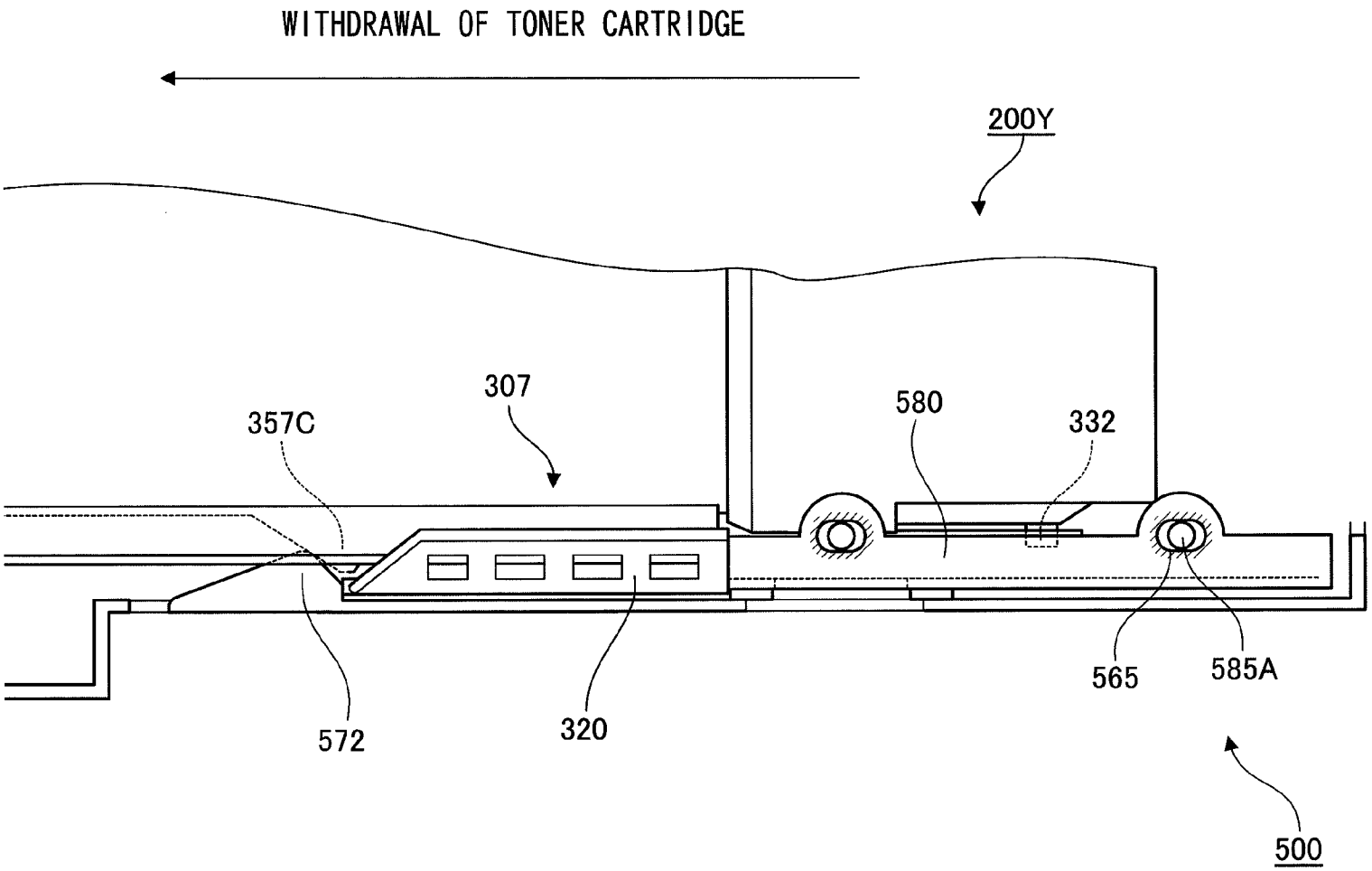

When the powder cartridge 200Y still moves backward from the state shown in FIG. 26, as shown in FIG. 27, the third retraction portion 357C provided to the powder cartridge 200Y strikes the second protrusion 572, and the second protrusion 572 comes to be retracted from the movement route of the powder cartridge 200Y. Accordingly, the second shutter 320 is enabled to pass through the second protrusion 572. Also, when the powder cartridge 200Y still moves backward from the state shown in FIG. 26, as shown in FIG. 27, the powder discharge port 307 moves to the above of the second shutter 320, and thereby the powder discharge port 307 is closed by the second shutter 320.

When the powder cartridge 200Y still further moves backward from the state shown in FIG. 26, the main body side shutter 590 (refer to FIG. 15) is moved by the protrusion 332 provided to the front end portion of the powder cartridge 200Y, and thus the through hole 586 (refer to FIG. 16) on the slidable member 580 is closed by the main body side shutter 590.

In the present exemplary embodiment, the third retraction portion 357C is configured to make contact with the second protrusion 572 after the powder discharge port 307 passes over a contact portion (a pressing portion) between the second shutter 320 and the slidable member 580. In other words, after the powder discharge port 307 passes over the contact portion between the second shutter 320 and the slidable member 580, the second shutter 320 whose movement has been regulated is moved. If the third retraction portion 357C makes contact with the second protrusion 572 before the powder discharge port 307 passes over the contact portion between the second shutter 320 and the slidable member 580, the gap is formed between the second shutter 320 and the slidable member 580, and the powder discharge port 307 results in passing over the gap.

As described above, in the present exemplary embodiment, the third retraction portion 357C makes contact with the second protrusion 572 after the powder discharge port 307 is closed by the second shutter 320. The slidable member 580 moves together with the powder cartridge 200Y along with the withdrawal operation of the powder cartridge 200Y, but movement thereof is regulated after the protrusion 585A (refer to FIG. 27) strikes the end portion of the long hole 565.

In the above description, the case where attachment or detachment of the powder cartridge 200Y is carried out by insertion or withdrawal of the powder cartridge 200Y is taken as an example, but the attachment or detachment of the powder cartridge 200Y may be carried out by rotating the powder cartridge 200Y in the circumferential direction. More specifically, for example, the powder cartridge 200Y may be attached by inserting the powder cartridge 200Y and then further rotating thereof in the circumferential direction. On the other hand, the powder cartridge 200Y may be detached by rotating the powder cartridge 200Y and then pulling out. In the case where the powder cartridge 200Y is thus attached or detached by being rotated, the slidable member 580 may be arranged on a movement route of the second shutter 320 in the rotation of the powder cartridge 200Y in the circumferential direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a powder containing portion that has a first opening formed thereon and contains powder inside thereof, the powder containing portion being attached to an attachment portion of the image forming apparatus by inserting the powder containing portion in a predetermined direction, the attachment portion comprises:

a second opening, a main-body closing member which covers and uncovers the second opening, a regulation member which holds the main-body closing member so that the main-body closing member slides with regard to the regulation member and which is loosely fixed to the attachment portion so that the regulation member slides in the predetermined direction and an opposite direction to the predetermined direction with regard to the attachment portion, and a closing portion as part of the attachment portion;

a container closing member which covers and uncovers the first opening and is arranged to move in the predetermined direction and the opposite direction of the predetermined direction with regard to the powder containing portion and, when the powder containing portion is being attached to the attachment portion of the image forming apparatus in the predetermined direction, whose movement is regulated by striking against the regulation member to make the container closing member uncover the first opening and to make a through path between the first opening and the second opening, and the container closing member, when the powder containing portion is being detached from the image forming apparatus in the opposite direction to the predetermined direction, whose movement is regulated by contacting the closing portion to cause the container closing member to cover the opening; and a moving portion that engages the regulation member with the powder containing portion and moves the regulation member in the opposite direction of the predetermined direction, when the powder containing portion is being detached from the image forming apparatus until the movement of the regulation member is regulated by the closing portion, the regulation member pushing the container closing member in the opposite direction of the predetermined direction, wherein when the powder containing portion is being detached from the image forming apparatus to the opposite direction in the predetermined direction, the first opening is covered by the container closing member after the regulation member is regulated by contacting with the closing portion.

2. The image forming apparatus according to claim 1, wherein, when the powder containing portion is attached to the image forming apparatus, the moving portion enters inside a groove provided to the regulation member, and when the powder containing portion is detached from the image forming apparatus, the moving portion moves the regulation member by use of a frictional force exerted between a wall surface of the groove and the moving portion.

3. The image forming apparatus according to claim 1, wherein, when the powder containing portion is detached from the image forming apparatus, the movement of the container closing member is regulated by striking against a protruding portion that protrudes on a movement route on which the container closing member moves, and the powder container further comprises a retraction portion that, after the opening is closed by the container closing member, presses the protruding portion and retracts the protruding portion from the movement route.

4. The powder container according to claim 3, wherein the protruding portion is located on an accommodating portion configured to receive the power containing portion.

5. The image forming apparatus according to claim 1, wherein the powder is a toner.

6. The image forming apparatus according to claim 1, wherein, when the powder containing portion is attached to the image forming apparatus, the moving portion holds the regulation member, and wherein, when the powder containing portion is pulled out from the image forming apparatus, the moving portion moves the regulation member so that a gap is not formed between the container closing member and the regulation member.

7. An image forming apparatus comprising: an attachment portion to which a container is attached and comprising a main-body opening and a main-body closing member which covers and uncovers a second opening, the container including a powder containing portion that has a container opening formed thereon and contains powder inside thereof, a container closing member that is provided to be movable with respect to the powder containing portion in a predetermined direction and an opposite direction to the predetermined direction to cover the container opening of the powder containing portion and a moving portion;

a releasing member that is loosely fixed to the attachment portion so that the a regulation member can slide in the predetermine direction and the opposite direction to the predetermined direction with regard to the attachment portion and, when the powder containing portion is being inserted into the attachment portion of the image forming apparatus in the predetermined direction, regulates movement of the container closing member to make the container closing member to uncover a first opening;

a closing portion that, when the powder containing portion is being detached from the image forming apparatus in the opposite direction to the predetermined direction, regulates movement of the container closing member to cause the container closing member to cover the container opening; and a moving unit that engages the moving part with the powder containing portion and moves the releasing member in the opposite direction to the predetermined direction when the container is detached from the attachment portion until a movement of the releasing member is regulated by the closing portion, the releasing member pushing the container closing member in the opposite direction of the predetermined direction, wherein when the powder containing portion is being detached from the image forming apparatus in the opposite direction to the predetermined direction, the container opening is covered by the container closing member after the releasing member is regulated by contacting the closing portion.

8. The image forming apparatus according to claim 7, wherein the releasing member is provided on an upstream side of the container closing member in the moving direction of the container closing member along with detachment of the container from the attachment portion, and the moving unit moves the releasing member and presses the releasing member against the closing member whose movement is regulated by the closing portion.

9. The image forming apparatus according to claim 8, wherein a pressing portion is formed at a contact portion between the releasing member and the container closing member, where the releasing member and the container closing member press each other by pressing the releasing member by the moving unit, the opening of the powder containing portion moves over the pressing portion when the powder containing portion moves along with the detachment of the container, and the closing portion removes regulation for the container closing member whose movement has been regulated after the opening of the powder containing portion that moves along with the detachment of the container passes over the pressing portion.

10. The image forming apparatus according to claim 7, wherein the releasing member makes contact with the container closing member when the releasing member regulates the movement of the container closing member that moves along with the attachment of the container to the attachment portion, and the moving unit moves the releasing member while maintaining the contact between the releasing member and the container closing member.

11. The image forming apparatus according to claim 7, wherein the moving unit moves the releasing member by use of a force applied by a user to the container when the container is detached.

12. The image forming apparatus according to claim 7, wherein the closing portion removes the regulation for the container closing member whose movement has been regulated, after closing the opening.

13. The image forming apparatus according to claim 7, wherein the powder is a toner.

14. The powder container according to claim 7, wherein the closing portion comprises a protruding portion located on the attachment portion.

15. The image forming apparatus according to claim 7, herein, when the powder containing portion is attached to the image forming apparatus, the moving portion holds the regulation member, and wherein, when the powder containing portion is pulled out from the image forming apparatus, the moving portion moves the regulation member so that a gap is not formed between the container closing member and the regulation member.

16. An image forming device comprising:

a container that comprises:

a container body which contains a powder, the container body having a first opening to supply the powder;

an outlet port configured to connect to an image forming device and which comprises a through hole connected to the first opening;

a container shutter which moves in a predetermined direction and a direction opposite to the predetermined direction to cover and uncover the outlet port; and a container shutter engaging part; and a container receiver configured to receive the container in the predetermined direction, the container receiver comprises:

a main body which receives the container and has a second opening which is configured to connect to the through hole;

a main body shutter which covers and uncovers the second opening;

a floating body which sustains the main body shutter so that the main body shutter moves in the predetermined direction and the opposite direction with regard to the floating body and is loosely fixed to the main body so that the floating body moves in the predetermined direction and the opposite direction with regard to the main body, and an edge of the container shutter abutting the floating body when the container is inserted into the container receiver;

a container shutter closing part which, when the container is being detached, engages the container shutter and moves the container shutter to cover the outlet port; and a floating body engaging part which is configured to engage the container shutter engaging part during a time from when the container shutter abuts the floating body when the container is inserted into the container receiver, to at least a time when the container shutter engages the container shutter closing part when the container is being detached from the container receiver so that the container shutter and the floating body move together as a one body and which releases the container shutter engaging part after the container shutter covers the outlet port.

17. The image forming device according to claim 16, wherein the container shutter engaging part comprises a protrusion located at the outlet port and an elastic member attached on the protrusion; and wherein the floating body engaging part comprises a holding member having a gap and which holds the protrusion and the elastic member within the gap when the container shutter abuts the floating body.

18. The image forming device according to claim 17, wherein at least a part of the main body shutters is located within the gap.

* * * * *